US008696371B2

(12) United States Patent
Byrne

(10) Patent No.: US 8,696,371 B2
(45) Date of Patent: Apr. 15, 2014

(54) CONDUIT GROUNDING CLIP

(76) Inventor: Norman R. Byrne, Ada, MI (US)

( * ) Notice: Subject to any disclaimer, the term of this patent is extended or adjusted under 35 U.S.C. 154(b) by 0 days.

(21) Appl. No.: 13/419,152

(22) Filed: Mar. 13, 2012

(65) Prior Publication Data

US 2012/0231645 A1 Sep. 13, 2012

Related U.S. Application Data

(60) Provisional application No. 61/452,146, filed on Mar. 13, 2011.

(51) Int. Cl.
*H01R 4/60* (2006.01)

(52) U.S. Cl.
USPC ..... 439/215; 439/98; 439/207

(58) Field of Classification Search
USPC ..... 439/215, 650, 96, 95, 207–211, 98
See application file for complete search history.

(56) References Cited

U.S. PATENT DOCUMENTS

| | | | | |
|---|---|---|---|---|
| 1,928,198 | A | 9/1933 | Buchanan | |
| 2,738,892 | A | 3/1956 | Wiesmann | |
| 2,811,574 | A | 10/1957 | Guerrero | |
| 2,996,566 | A | 8/1961 | Stas | |
| 3,131,512 | A | 5/1964 | MacLeod, Jr. | |
| 3,395,243 | A | 7/1968 | Kelly | |
| 3,433,886 | A | 3/1969 | Myers | |
| 3,622,684 | A | 11/1971 | Press | |
| 3,794,956 | A | 2/1974 | Dubreuil | |
| 3,975,074 | A | 8/1976 | Fuller | |
| 4,367,370 | A | 1/1983 | Wilson | |
| 4,579,403 | A | 4/1986 | Byrne | |
| 4,666,223 | A | 5/1987 | Tillmann | |
| 4,775,328 | A | 10/1988 | McCarthy | |
| 4,781,609 | A | 11/1988 | Wilson | |
| 4,990,110 | A | 2/1991 | Byrne | |
| 4,993,576 | A | 2/1991 | Byrne | |
| 5,087,207 | A | 2/1992 | Byrne | |
| 5,096,431 | A | 3/1992 | Byrne | |
| 5,096,434 | A | 3/1992 | Byrne | |
| 5,122,069 | A | 6/1992 | Brownlie | |
| 5,259,787 | A | 11/1993 | Byrne | |
| 6,991,485 | B2 * | 1/2006 | Plattner et al. | 439/215 |
| 7,494,356 | B2 * | 2/2009 | Byrne | 439/215 |
| 7,699,640 | B2 * | 4/2010 | Brekosky et al. | 439/350 |
| 8,262,401 | B1 * | 9/2012 | Byrne | 439/215 |
| 2005/0095890 | A1 * | 5/2005 | Plattner et al. | 439/215 |
| 2006/0292009 | A1 * | 12/2006 | Arata | 416/203 |
| 2008/0214033 | A1 * | 9/2008 | Byrne | 439/215 |
| 2008/0280470 | A1 * | 11/2008 | Byrne | 439/215 |
| 2010/0190369 | A1 * | 7/2010 | Byrne | 439/215 |
| 2011/0021050 | A1 * | 1/2011 | Byrne | 439/215 |

* cited by examiner

*Primary Examiner* — Gary Paumen
(74) *Attorney, Agent, or Firm* — Varnum, Riddering, Schmidt & Howlett LLP

(57) ABSTRACT

A wireless raceway (100) employs bus bars (121), instead of cabling or other types of wires. The raceway (100) includes a pair of junction blocks (102). A bus bar assembly (116) holds the individual bus bars (121). The raceway (100) also includes a pair of modified H-terminals (122) having a central bus bar terminal (124) connected to each of a pair of receptacle terminals (126). The modified H-terminals (122) connect the individual bus bars (121) to external electrical assemblies through the junction blocks (102) without the need of wires or cables.

9 Claims, 23 Drawing Sheets

CONDUIT GROUNDING CLIP

CROSS-REFERENCE TO RELATED APPLICATIONS

This application claims priority of U.S. Provisional Patent Application Ser. No. 61/452,146 filed Mar. 13, 2011.

STATEMENT REGARDING FEDERALLY SPONSORED RESEARCH OR DEVELOPMENT

Not applicable.

REFERENCE TO A MICROFISHE APPENDIX

Not applicable.

BACKGROUND OF THE INVENTION

1. Field of the Invention

The present invention relates to electrical power systems and, more particularly, to arrangements for providing a raceway having non-metallic conduits and, more particularly, to a grounding clip configuration for providing grounding of conduits carrying electrical power.

2. Background Art

The use of computers, associated computer peripherals (e.g. printers and the like), copiers, facsimile machines, sophisticated telecommunications equipment and other electronic devices is continuing to rapidly increase in commercial, industrial and office environments. As a result, the importance of efficiently supplying power throughout these environments is also increasing. For example, the use of modular office systems, with multiple workstations and interior walls, has led to electrical systems relatively more sophisticated than conventional designs comprising receptacle mounts and electrical receptacles in stationary walls, with the receptacles energized from incoming power supplies extending through wall interiors. Such conventional and stationary wall-mounted systems were often located a substantial distance from the electrical devices to be energized and numerous electrical cords connecting the devices to the outlets would cause unsightly and sometimes dangerous entanglements. Thereafter, movable pluggable units having a number of receptacles on a common power source cord to be plugged into the conventional utility outlets were used. Again, however, such units resulted in unsightly and entangled arrays of electrical device cords.

With the growth of the use of electrical power in office systems, it became known to employ removable wall panels or the like, which defined modular workplace areas. Further, raceway areas were developed for use in the panels or other structures, for accommodating electrical wiring and electrical junction blocks near the locations to be energized. Typically, junction blocks were mounted within the raceway areas by attaching them with various types of structural arrangements. Outlet receptacle blocks having a number of receptacles were first formed as an integral part of the junction blocks. Thereafter, it became known to employ receptacles which were assembled as devices separate from the junction blocks, but were mechanically and electrically connectable to the junction blocks. During the past two decades, a substantial amount of research and development have been directed to raceways, junction blocks and receptacles, means for interconnection of the junction blocks and receptacles, and mounting of the junction blocks within the raceways.

Various arrangements have been utilized in the recent past in an attempt to provide electrical power. For example, McCarthy, U.S. Pat. No. 4,775,328, issued Oct. 4, 1988, discloses an electrical power assembly for installation in a raceway of a wall panel, of a type commonly used in modular wall systems for constructing office and other work areas. The McCarthy configuration includes a power block having seven wires, representing three separate circuits, and several ports for receiving different outlet receptacle adapters or modules. Different modules are utilized to connect a power cord or the like to the different circuits of the power block. Each of the ports of the power block has seven terminals, corresponding to the seven wires, and each of several outlet receptacle modules has a uniquely positioned set of three terminals for engaging a predetermined set of three of the seven power block terminals. In this manner, different outlet receptacle modules provide electrical connections to different ones of the three separate circuits. A disadvantage of this prior art arrangement is that a separate supply of receptacle modules must be kept, and a receptacle module of proper type must be found each time a change is to be made to a different circuit arrangement. This presents a substantial inconvenience to the user and requires a separate stocking of these parts.

Byrne, U.S. Pat. No. 5,087,207, issued Feb. 11, 1992, presented a substantial advance with respect to circuit selection. The Byrne arrangement utilized a pair of adapter blocks, each arrangeable in two physical orientations. These blocks provided an interface between an electrical outlet receptacle block and four different electrical circuits of a power distribution block. Each of the adapter blocks included terminals on one end for engaging the receptacle block, including one terminal disposed on the centerline of the adapter and a pair of terminals disposed on opposing sides and equidistant from the centerline. Further, each adapter block included terminals on an opposite end for engagement with the power distribution block. The adapter block also included terminals disposed on opposite sides of the centerline and offset from the centerline by different distances. Each adapter block could be changed from one physical orientation to another by rotation about the centerline. One of the blocks, in a first physical orientation, connected a first positive terminal, a first neutral terminal and a ground terminal of the power distribution block to the outlet receptacle block. In a second orientation, connection was made to a second one of the positive terminals, a second one of the neutral terminals and a ground terminal of the power distribution block to the outlet receptacle block. Correspondingly, the second adapter block, in a first physical orientation, connected a third positive terminal, a third neutral terminal and a ground terminal of the power distribution block to the outlet receptacle block. In a second physical orientation, the second adapter block connected a fourth positive terminal, a fourth neutral terminal and a ground terminal of the power distribution block to the outlet receptacle block.

Wilson et al, U.S. Pat. No. 4,367,370, issued Jan. 4, 1983, discloses an outlet receptacle block having a ground terminal, a common terminal and three positive terminals for engaging corresponding terminals of a junction block. The ground and common terminals are connected to the ground and common receptacle output terminals for engagement with the prongs of a standard three-prong electrical cord. The receptacle block further includes a switch which selectively connects one of the three positive prongs to the positive receptacle outlet connector, internal to the outlet receptacle block.

In another prior art arrangement in Tillmann, U.S. Pat. No. 4,666,223, issued May 19, 1987, an outlet receptacle block is provided with a movable terminal to selectively engage one of three positive junction block terminals. The outlet receptacle block of this prior art arrangement includes a conducting shaft electrically connected to the positive outlet terminal of the outlet receptacle block and to the movable terminal. The movable terminal may be slid upwardly or downwardly to a desired position for engagement with one of three positive connector terminals of the junction block.

In yet another prior art arrangement in Wilson et al, U.S. Pat. No. 4,781,609, issued Nov. 1, 1998, an outlet receptacle block is provided with a pair of slideable terminals mounted on a carrier so as to provide for synchronous movement of two contacts. A junction block is provided with a ground terminal, three positive terminals and three common terminals, thereby defining three separate circuits with a common ground. The carrier on the outlet receptacle block may be positioned so that one of its terminals engages one of the positive terminals of the junction block, while the other engages the corresponding common terminal. A sliding electrical contact internal to the receptacle block provides contact between the moveable terminals and corresponding terminals for engagement with the prongs of a standard electrical cord.

With several of the above-mentioned prior art arrangements, an electrical switch contact between a moveable part and a stationary part is employed to connect the outlet terminals of the outlet receptacle block.

Byrne, U.S. Pat. No. 5,096,431, issued Mar. 17, 1992, provided another substantial advance with an outlet receptacle block having rearrangeable terminals. In Byrne, an electrical outlet receptacle block comprises a housing and at least one flexible bus bar having one portion fixedly attached to the housing and electrically connected to one of the outlet receptacle terminals of the receptacle block. An end of the flexible bus bar is a moveable terminal end, which may be moved to at least two separate positions for selective alignment with different terminals of a junction block having at least two different circuits.

Byrne discloses one embodiment with an electrical junction block comprising eight terminals, with four positive terminals, two neutral terminals and two ground terminals. The outlet receptacle block is provided with three bus bars for connection to positive, neutral, and ground outlet terminals. The flexible bus bars may be selectively positioned to connect the ground outlet terminal to either of the two ground junction block terminals. In addition, the neutral outlet terminal can be connected to either of the two neutral junction block terminals, and the positive outlet terminal can be connect to any one of the four positive junction block terminals.

The outlet receptacle block can be provided with at least one manually operable control lever engaging the moveable end of at least one flexible bus bar. The housing of the receptacle outlet block is provided with an elongated slot on one surface for accommodating the control lever. The control lever can be disposed partially below the surface, with a protuberance extending through the slot. The protuberance is of a generally rectangular shape and fits snugly in the opening to prevent any significant rotation. The control lever, of which the protuberance is a part, is provided with an opening which engages a longitudinal section of a conductor bar. Movement of the control lever in the slot causes a bending in a portion of the control bar between the control lever and a fixed anchor point of the flexible bus bar internal to the receptacle outlet block housing. A terminal end portion of the bus bar extends beyond the control lever substantially perpendicular to an end wall of the receptacle block housing. This is provided for engagement with terminals of the junction block.

Stas, U.S. Pat. No. 2,996,566 discloses a floor-type outlet box for use within concrete flooring. The outlet box includes a duplex receptacle positioned so that the receptacle outlets extend vertically upward slightly beneath the floor level. A cover plate is hingedly mounted to the box and capable of being sealed to provide a water-tight housing flush with the concrete floor. Another, still earlier, disclosure of a junction box having electrical outlets for use in concrete floors is set forth in Buchanan, U.S. Pat. No. 1,928,198. The Buchanan patent is primarily directed to an arrangement for adjusting the position of the outlet box after the concrete floor is poured so as to compensate for any undesired displacement.

Several of the known arrangements for providing electrical receptacles in floors include arrangements for selectively positioning the receptacles between exposed and concealed positions. For example, Press, U.S. Pat. No. 3,622,684 discloses a floor receptacle mounting unit having electrical receptacles which can be rotated to a position in which the receptacles are exposed above the level of the floor or, alternatively, rotated to positions in which the receptacles are concealed below the floor level. Myers, U.S. Pat. No. 3,433,886 discloses an electrical junction box to be mounted flush with a floor. The junction box adjustably mounts an electrical service or receptacle box which is reces sable below the floor surface through the use of adjusting machine screws. Other floor mounted electrical junction boxes and receptacles are shown in the following references: Kelly, U.S. Pat. No. 3,395,243; Wiesmann, U.S. Pat. No. 2,738,892; Fuller, U.S. Pat. No. 3,975,074; Guerrero, U.S. Pat. No. 2,811,574; MacLeod, Jr., U.S. Pat. No. 3,131,512; and Dubreulio, U.S. Pat. No. 3,794,956.

With respect to the previously cited references, most of these references are directed to floor mounted electrical receptacles and junction boxes to be mounted in permanent flooring. However, with the increase in use of modular offices, and for various other design and structural reasons, the use of access flooring is becoming more widespread. Such access flooring also allows the positioning of junction boxes and incoming power and signal cables to be placed beneath the floor after or during the design of the office systems (modular or otherwise) to be employed within the commercial or industrial environment. Such access flooring also allows for power and signal cables to be placed beneath the floor in a position which will not necessarily interfere with the placement of walls or, for that matter, furniture placement following complete office design. In addition, the use of such access flooring allows for junction boxes, electrical outlet boxes, power and signal cables to be selectively moved as the office systems are rearranged.

In known systems for utilizing electrical power with access flooring, power and signal cables are interconnected between incoming power supplies and junction or electrical receptacle boxes referred to herein as access floor modules. Appropriate office equipment is directly connected to receptacle outlets within the access modules which are designed specifically for receiving the receptacle outlets.

An example of a known access floor module is disclosed in Brownlie et al., U.S. Pat. No. 5,122,069. With reference to the drawings and the numerals disclosed in the Brownlie et al. patent, FIGS. 1-4 illustrate an access flooring module to be mounted in an opening 4 provided in an access floor. The module 2 is movable between an open position (FIG. 3) and a closed position (FIG. 4). Recesses 24 are provided so as to receive electrical components such as power sockets 34 or signal sockets 36 shown in FIG. 1. Metal plates 25 (shown in FIG. 2) selectively provide electrical contact with electrical components to be utilized with the module 2.

In an alternative embodiment of the Brownlie et al. patent, FIG. 12 depicts interconnection of high tension cables 240 and low tension cables 241 to the rear of an alternative module 200. The high tension cable 240 is secured through a hard wire bracket 209, with the low tension cable 241 secured through a data bracket 211. Cable ties 242 are utilized to secure the cables to the rear of the module.

Although the prior art shows a number of designs for floor-mounted boxes capable of mounting electrical receptacles, an important aspect of floor-mounted arrangements is the overall "system." The overall system includes all of the junction boxes, electrical receptacle boxes and outlets, and the requisite cabling, including the means for interconnection of cabling. For example, if the system requires cables of different types with respect to lengths, connectors, and other structural considerations, the system designer's job is more complex, since the designer must essentially have a final system design before ordering the requisite cabling. Although an inventory of various cables may be ordered and stored, such an inventory may be expensive, take up valuable storage space and involve components which are never used. Still further, if a voluminous inventory is not desired, the designer must have exact details as to positioning of electrical outlets, system dimensions and other layout information before undertaking the process of ordering the cabling.

Other design and assembly issues for these types of electrical systems relate to system components other than cabling. For example, such systems may utilize one type of component for a junction box, and another type of component for mounting electrical receptacles. Again, such a structure suffers from the same problems previously described with respect to requiring various types of cables for the overall system.

In addition to issues associated with cabling, junction boxes and receptacle mounting structures, the means for interconnecting system components is also important. For example, if the interconnection of cables to other cables, or to junction boxes and the like, requires hard-wired connections, problems arise with respect to both design and assembly.

In addition to the foregoing, other issues associated with raceways involve the types of materials utilized in strain relief. For example, it would be advantageous to provide for non-metallic conduit raceways, which also provide for strain relief.

SUMMARY OF THE INVENTION

In accordance with the invention, a raceway is adapted to supply and transfer electrical power. The raceway includes a pair of junction blocks, each adapted to supply power to one or more receptacle blocks. A bus bar set includes a series of bus bars, with opposing ends extending to each of the junction blocks. A pair of terminal element sets is provided. Each of the terminal element sets is positioned at an opposing end of each of the bus bars. Each terminal element set comprises first terminal means electrically connected to an end of a corresponding one of the bus bars. Second terminal means are electrically engaged with the first terminal means, for electrically engaging the bus bar with external electrical means. Third terminal means are electrically connected to the first terminal means, for electrically engaging the bus bars with receptacle blocks. The raceway is formed and functions in the absence of any wire or cable components.

In accordance with another aspect of the invention, the raceway can include a bus bar set having a series of bus bars, with a terminal element set positioned at one end of the bus bars. The terminal element set includes first terminal means connected to one end of each of the bus bars. Second terminal means provide for electrically connecting the bus bars to a second set of bus bars. An external cable assembly is provided, with a set of cables having a set of slide terminals or adjustable connectors at the ends thereof. A second set of bus bars have one set of ends electrically connected to the second terminal means. An opposing set of ends of the second set of bus bars is electrically connected to the slide terminals. In this manner, each of the second set of bus bars is in an adjustable, electrical and sliding engagement with corresponding ones of the slide terminals.

BRIEF DESCRIPTION OF THE DRAWINGS

The invention will now be described with respect to the drawings, in which.

DETAILED DESCRIPTION

Figure 1:
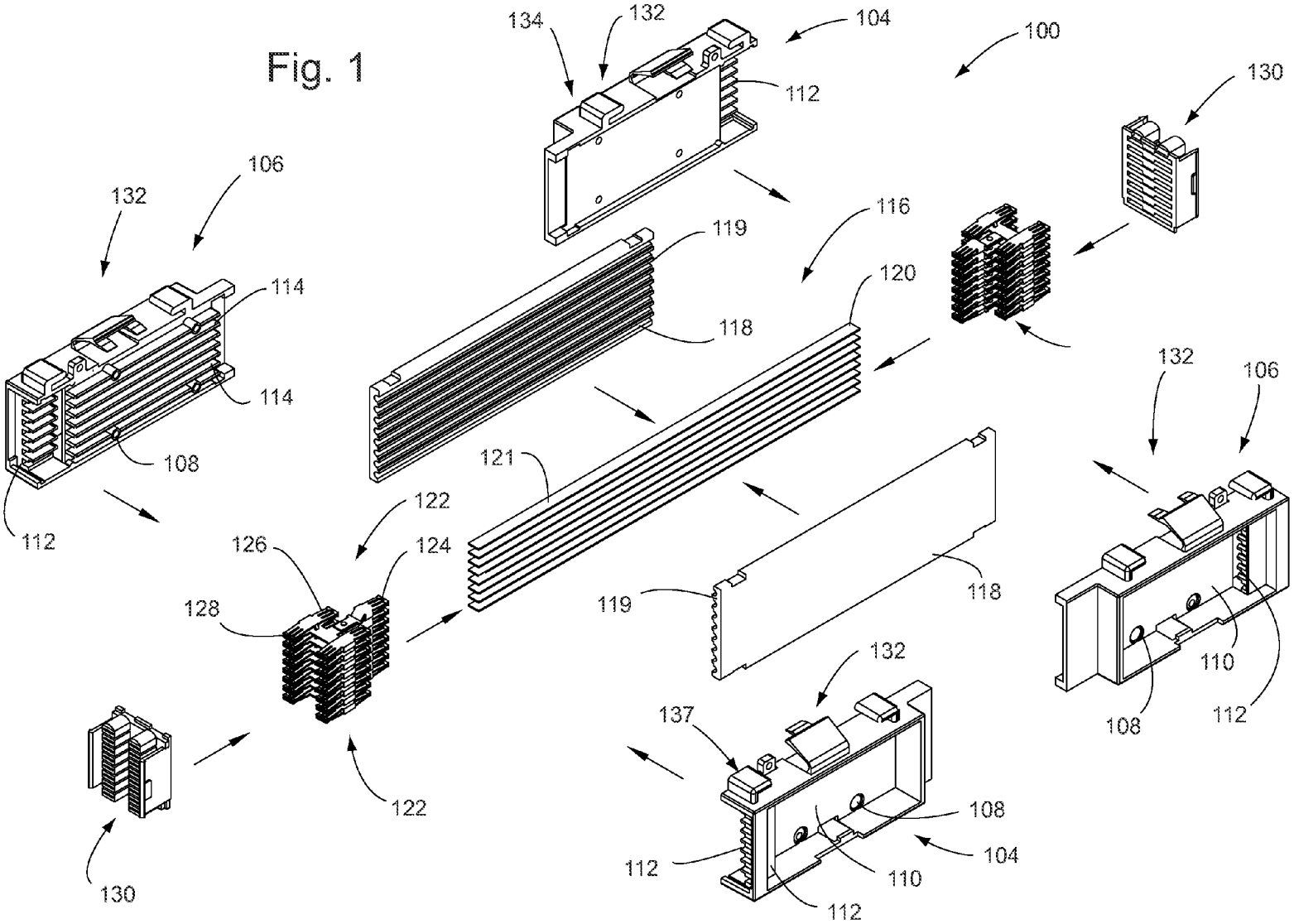
FIG. 1 is a perspective and exploded view of a prior art wireless raceway.
Figure 2:
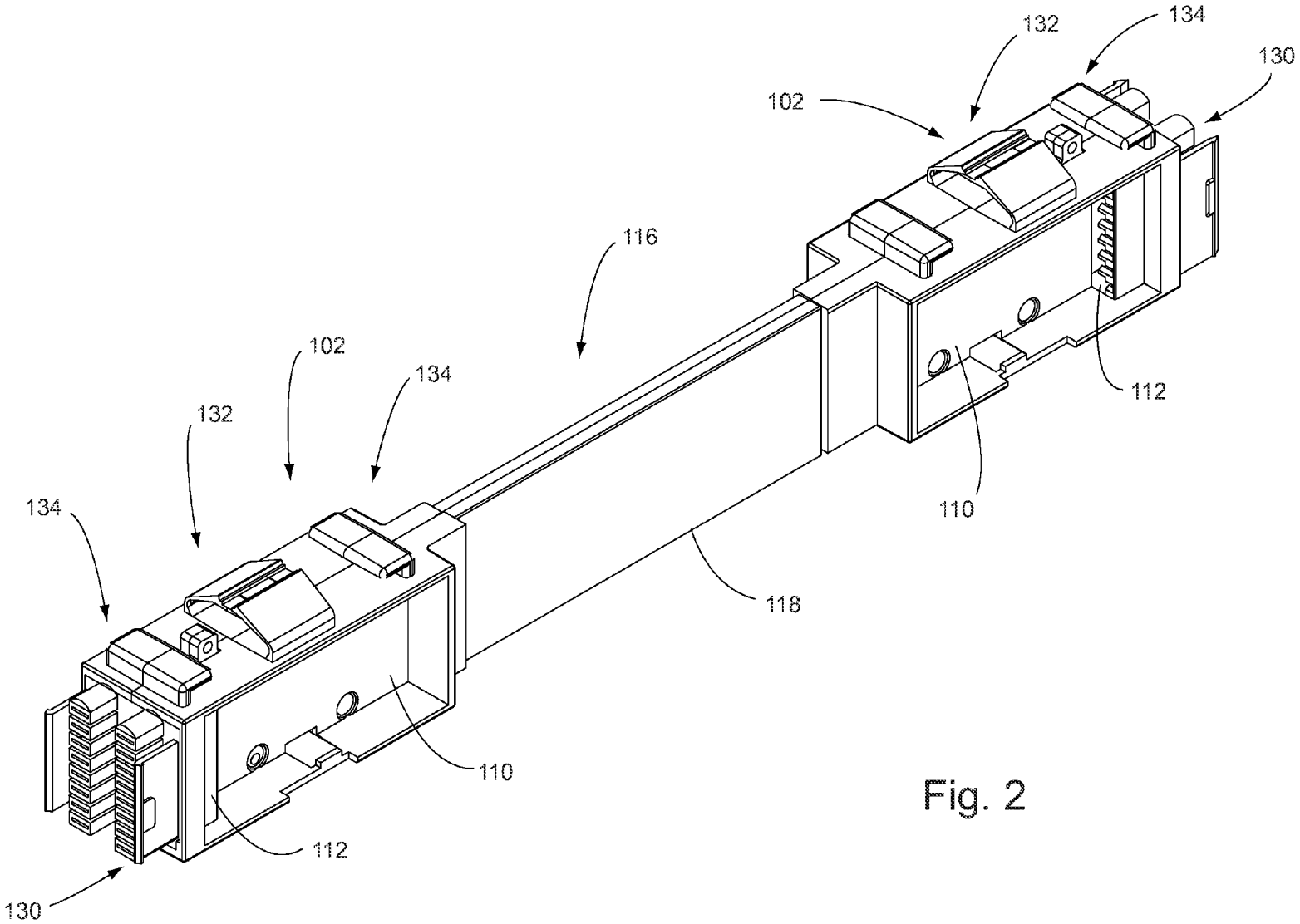
FIG. 2 is a perspective view of the wireless raceway illustrated in FIG. 1, but shown in a fully assembled configuration.
Figure 4:
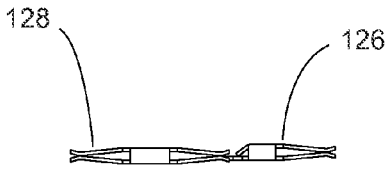
FIG. 4 is a front elevation view of the terminal shown in FIG. 3.
Figure 3:
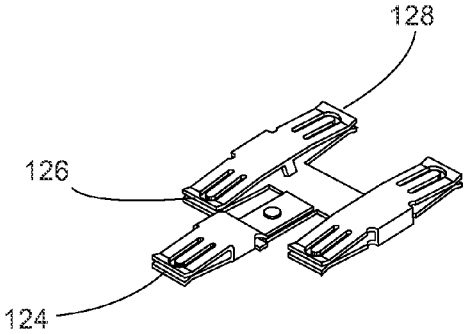
FIG. 3 is a perspective view of a terminal which may be utilized with a wireless raceway in accordance with the invention.
Figure 5:
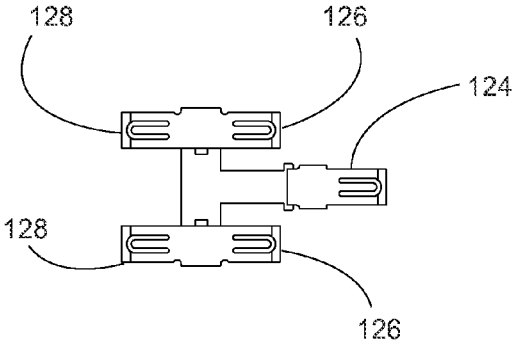
FIG. 5 is a plan view of the terminal shown in FIG. 3.
Figure 6:
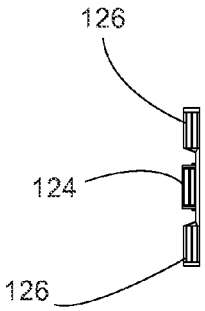
FIG. 6 is a side elevation view of the terminal shown in FIG. 3.

The principles of the invention are disclosed, by way of example, in a series of conduit grounding clips as illustrated in FIGS. 13-61. For purposes of showing example uses of conduits and the like, a series of raceways are first described and illustrated with respect to FIGS. 1-12. The wireless raceway 100 employs bus bars instead of cabling or other types of wires. With reference specifically to FIGS. 1 and 2, the wireless raceway 100 comprises a pair of junction blocks 102. Each of the junction blocks 102 includes a first half 104 and a second half 106. The junction blocks 102 are adapted to supply power to multiple receptacle blocks which are essentially "plugged in" to the junction blocks 102. For purposes of description of the invention, the multiple receptacle blocks are not shown in the drawings.

To assemble a junction block 102, the first half 104 and the second half 106 are interconnected by means of rivets 108. As shown in FIGS. 1 and 2, each of the junction blocks 102 includes a receptacle space 110. The receptacle space 110 includes a set of receptacle terminals extending outwardly into the corresponding receptacle space 110. The receptacle terminals 112 can comprise a set of male terminals adapted to electrically interconnect to receptacles blocks (not shown) having multiple receptacles. Such receptacle blocks are well known in the electrical industry. Also, the concept of providing the receptacle space 110 and receptacle terminals 112 is also well known in the prior art. As further shown in FIG. 1, and although only shown with respect to one of the junction blocks 102, the second half 106 of one of the junction blocks 102 includes a set of horizontally disposed bus bar isolators 114. These isolators are essentially insulative and serve to separate and electrically isolate bus bars which will be inserted within the junction blocks 102 as subsequently described herein. Although the bus bar isolators 114 are only shown with respect to one of the junction blocks 102, the bus bar isolators 114 also exist with respect to the other junction block 102.

Another component of wireless raceway 100 is the bus bar assembly 116. The bus bar assembly 116 is shown in exploded view in FIG. 1 and in a fully assembled view in FIG. 2. Specifically, the bus bar assembly 116 includes a pair of side panels 118. The side panels 118 include bus bar connectors 119 which are adapted to hold individual bus bars 121 of a bus bar set 120.

The wireless raceway 100 also includes a pair of sets of terminal elements or modified H-terminals 122, as illustrated in FIG. 1. Each of the terminal elements or modified H-terminals 122 includes a central or connecting beam forming a central bus bar terminal 124. In turn, the central bus bar terminal 124 is integral with or otherwise connects electrically to a pair of receptacle terminals 126. The receptacle terminals 126 are, in turn, electrically connected to external terminals 128. Details of each of the modified H-terminals 122 are illustrated in FIGS. 3, 4, 5 and 6. The terminals of the modified H-terminal 122 are adapted to electrically receive male blade terminals. The modified H-terminals 122 are, as shown in FIG. 1, essentially "stacked" in a vertical configuration. The wireless raceway 100 will include a separate modified H-terminal 122 for each potential entry or exit electrical connection. Additional detail regarding connector assemblies, such as the modified H-terminal 122, are disclosed in Byrne, U.S. Pat. No. 4,990,110, issued Feb. 5, 1991, and Byrne, U.S. Pat. No. 5,096,434, issued Mar. 17, 1992. The disclosures of these patents are hereby incorporated by reference herein. These patents illustrate an H-terminal configuration having similarity to the modified H-terminal 122.

The wireless raceway 100 also includes a pair of terminal caps or cable connectors 130. These terminal caps or cable connectors 130 are illustrated in FIGS. 1 and 2. These terminal caps or cable connectors 130 are well known in the art and provide for electrical interconnection between terminals of the modified H-terminals 122 and external cables or connectors (not shown). Each of these female terminal caps or cable connectors 130 is provided with a side flange having upper and lower recessed areas. The upper and lower recessed areas are adapted to assist in providing engagement with flanges of a male connector block associated with a cable assembly (not shown). In this manner, a releasable locking engagement can be provided between the external terminals 128 of the modified H-terminals 122 and male connectors of a cable assembly or the like (not shown). The side flanges are preferably made of a resilient plastic material and formed integral with the housing of the junction blocks 102. The side flanges can also be provided with an outwardly extending inclined end surface. When the surfaces are engaged by flanges, such as flanges of male cable or connector blocks, the side flanges can be deflected inwardly, allowing the flanges of the male connector block to engage upper and lower recessed areas, so as to provide a releasable locking engagement of the male connector block and the external terminals 128. For purposes of releasing a cable assembly or connector block mechanically and electrically interconnected to a junction block 102 through the external terminals 128, pressure may be exerted inwardly on the corresponding side flange, and the flanges of the male connector block will then be released from the recesses, and the male connector block can then be retracted from the external terminals 128. In addition, a "keying" arrangement may be utilized for interconnecting a cable assembly or connector block to the junction block 102. In this regard, each of the external terminals 128 may be provided with a key lug, and the male connector block may be provided with a key opening for receiving the key lug.

Each of the junction blocks 102 may also be adapted to be secured at its upper portion to a structure for housing electrical components and modular office systems and the like. The means for mounting the junction blocks 102 to such structures could include the use of latch members 132 and raceway connectors 134. The use of these types of mounting assemblies and their attachment to structural members are disclosed in Byrne, U.S. Pat. No. 5,259,787, issued Nov. 9, 1993 and Byrne, U.S. Pat. No. 4,993,576, issued Feb. 19, 1991.

For purposes of assembly, the side panels 118 of the bus bar assembly 116 may be coupled to flanges of the junction blocks 102. The bus bars 121 of the bus bar set 120 may then be inserted between the side panels and into the junction blocks 102 between the bus bar isolators 114. With this configuration, the modified H-terminals 122 can then be inserted into one end of each of the junction blocks 102. The modified H-terminals 122 will be inserted so that their central bus bar terminals 124, having a female configuration, electrically receive the ends of bus bars 121. Still further, the female receptacle terminals 126 will electrically receive the male receptacle terminals 112. Accordingly, an electrical connection is established between the bus bars 121 and the receptacle terminals 112. In this manner, when receptacle blocks (not shown) are inserted into the junction blocks 102, an electrical connection is established with the bus bars 121.

Still further, the terminal caps or cable connectors 130 can then be inserted into the ends of the modified H-terminals 122, so that the external female terminals 128 of the modified H-terminals 122 are made electrically accessible to cable assemblies or the like (not shown) which may be connected to the terminal caps or cable connectors 130. In this manner, the wireless raceway 100 is provided.

Although the wireless raceway 100 provides for a substantial advance in the state of the art, the raceway 100 does not include structure providing for length adjustment with respect to cables. It is known in the art to accommodate distance requirements between and among electrical components by providing for cables or conduits which are adjustable in length. For example, it is known to provide for an expandable flexible conduit. In such an arrangement, the male or end connector block may be provided with an inner spatial area. The inner spatial area can be provided for storage of excess length of electrical wiring in an coiled or similar configuration. The excess length of electrical wiring may be withdrawn from the adjustable conduit section and expanded to an extended length. This type of an arrangement is disclosed in Byrne, U.S. Pat. No. 5,096,434, issued Mar. 17, 1992 and Byrne, U.S. Pat. No. 4,579,403, issued Apr. 1, 1996.

Figure 7:
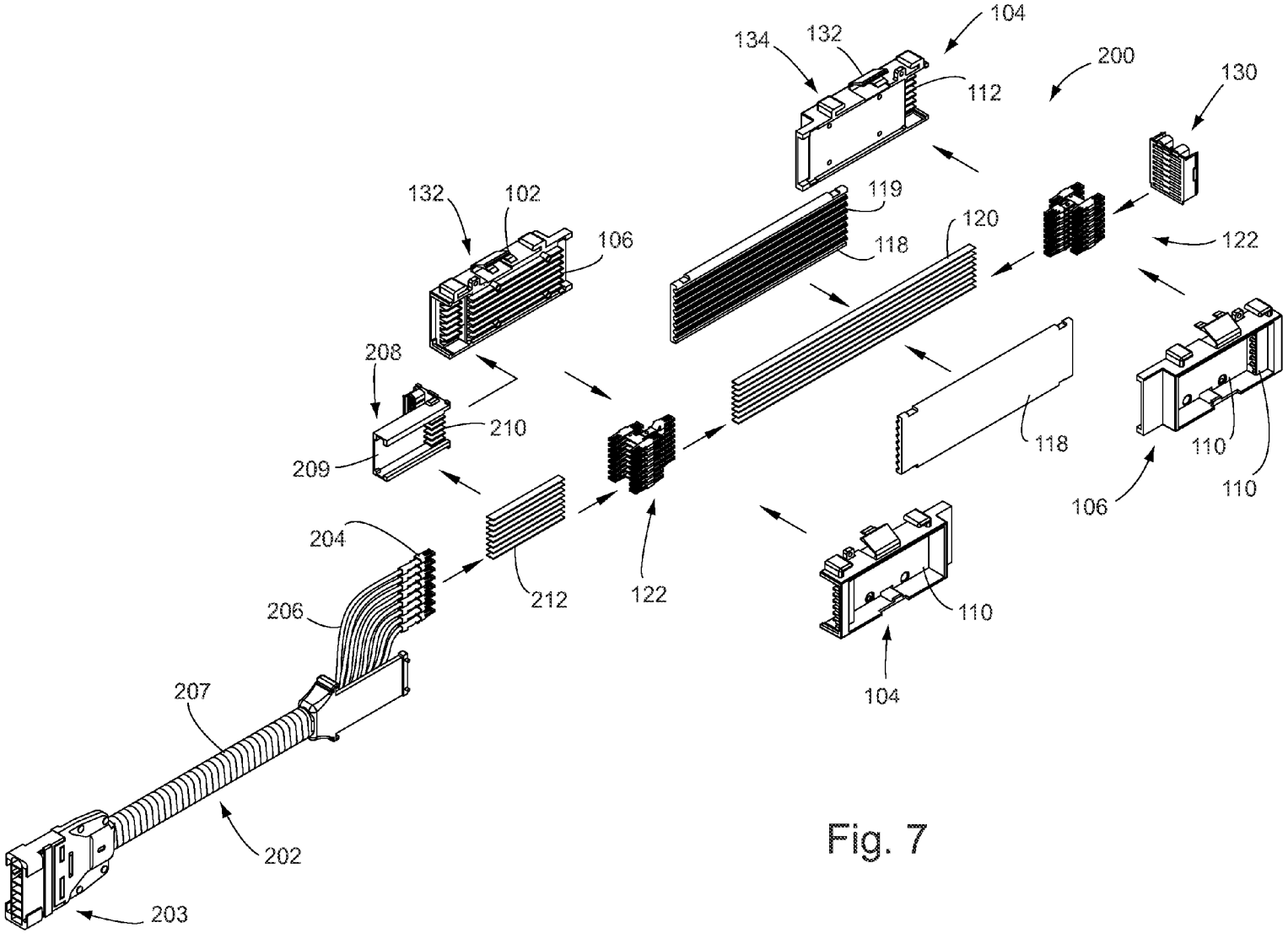
FIG. 7 is a perspective and exploded view of a wireless raceway with an adjustable cable in accordance with the invention.
Figure 8:
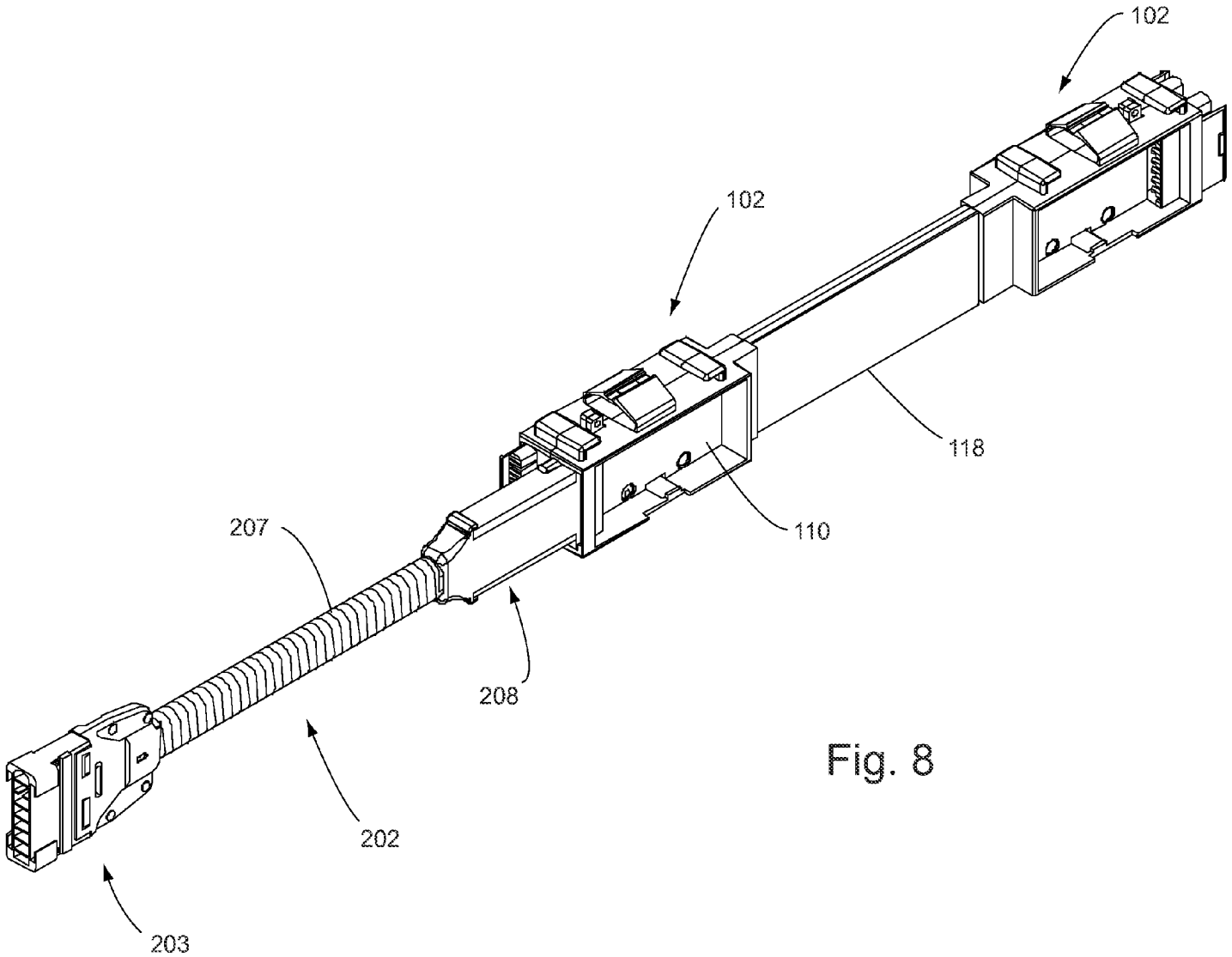
FIG. 8 is a perspective view of the adjustable wireless raceway illustrated in FIG. 7, but shown in a fully assembled configuration.
Figure 9:
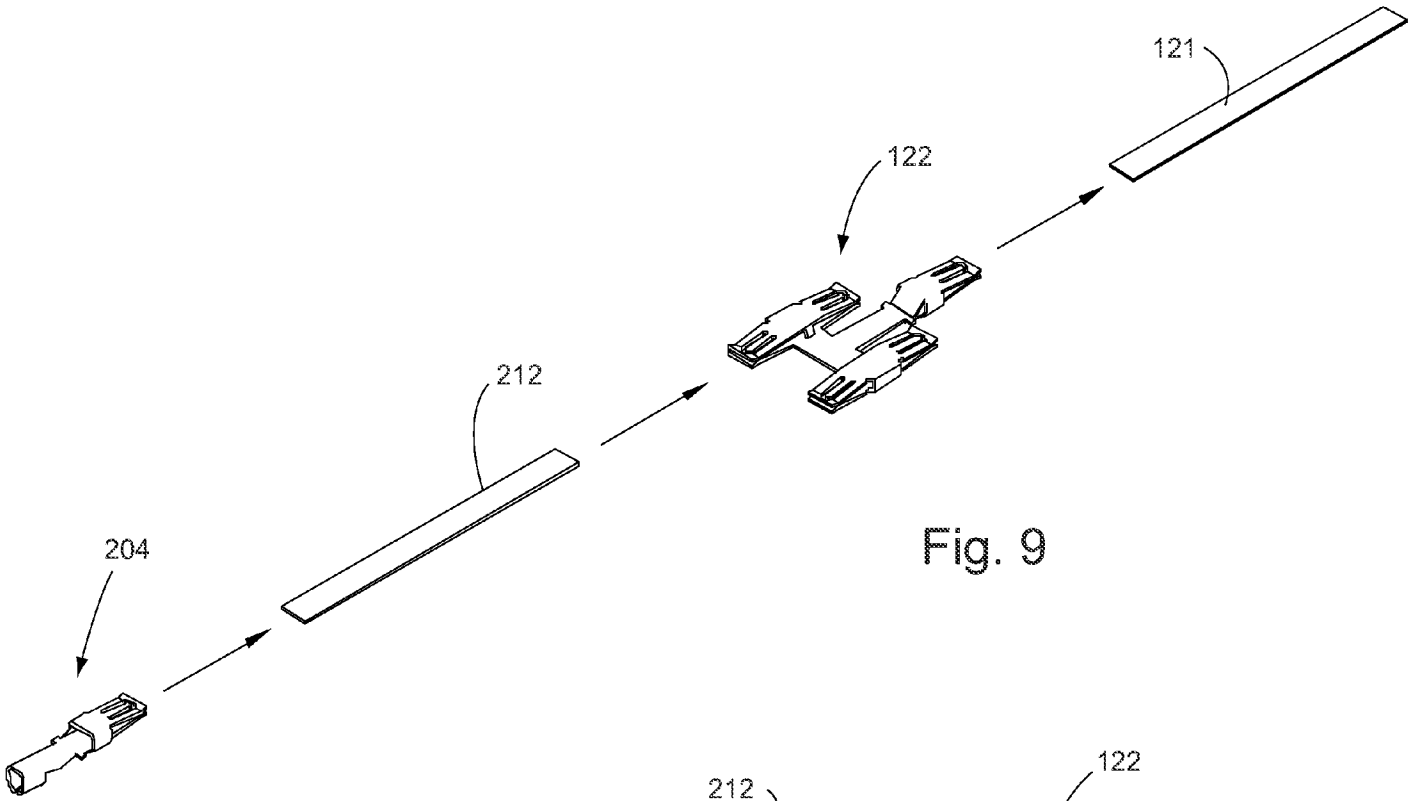
FIG. 9 is a perspective and exploded view showing the interconnections of terminals, connectors and bus bars for providing adjustability to the wireless raceway shown in FIG. 7.

To accommodate for length adjustment in a wireless raceway, a further embodiment of a wireless raceway 200 is disclosed herein and illustrated in FIGS. 7, 8, 9 and 10. As shown in FIGS. 7 and 8, the wireless raceway 200 includes substantially all of the elements which are shown and have been previously described herein with respect to the wireless raceway 100. Functional identical components are identically numbered in the drawings illustrating wireless raceway 200, with respect to wireless raceway 100. However, in addition to the components of wireless raceway 100, the adjustable raceway 200 includes an external cable assembly 202. The external cable assembly 202 includes a terminal end 203 coupled through a conduit 207 to a connector block 205. As shown in FIG. 7, a set of cables 206 extends through the cable assembly 202. At the terminal ends of the cables 206 associated with the connector block 205 are a set of slide terminals or adjustable connectors 204. Details of the adjustable connectors 204 are primarily illustrated in FIGS. 9 and 10.

The adjustable raceway 200 further includes an adjustment block 208 having a cover 209 as shown in FIG. 7. The adjustment block 208 is somewhat similar to the previously described terminal caps or cable connectors 130. However, the adjustment block 208 is adapted to receive a set of adjustment bus bars 112. The adjustment bus bars 212 can be mechanically connected to the connector block 205 of the cable assembly 202 in any suitable and well known manner. With this connection, the configuration of the wireless raceway appears as illustrated in a fully assembled state in FIG. 8.

Figure 10:
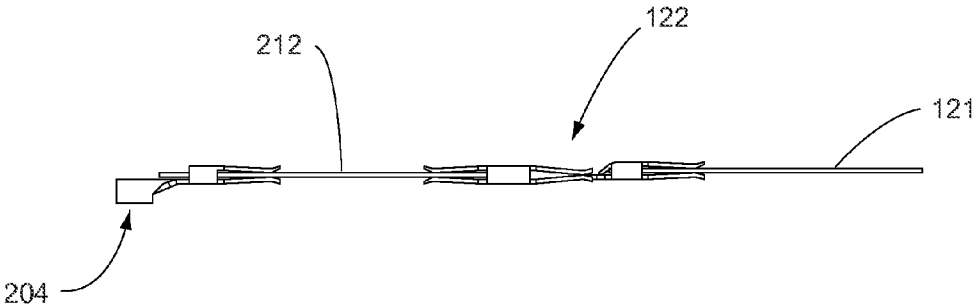
FIG. 10 is a perspective view of the connectors, terminals and bus bars shown in FIG. 9, but shown in a fully assembled configuration.

Returning to the adjustment block 208, the adjustment bus bars 212 are electrically and mechanically inserted into one set of the external terminals 128 of one of the modified H-terminals 122. The other ends of the adjustment bus bars 212 are then inserted into the slide terminals or adjustable connectors 204, as primarily illustrated in FIG. 10. As shown in FIG. 10, the slide terminals or adjustable connectors 204 can be made to move along the longitudinal length of a corresponding one of the adjustment bus bars 212. In this manner, the length of the cable assembly 202 can be modified, while still retaining a wireless raceway.

Figure 11:
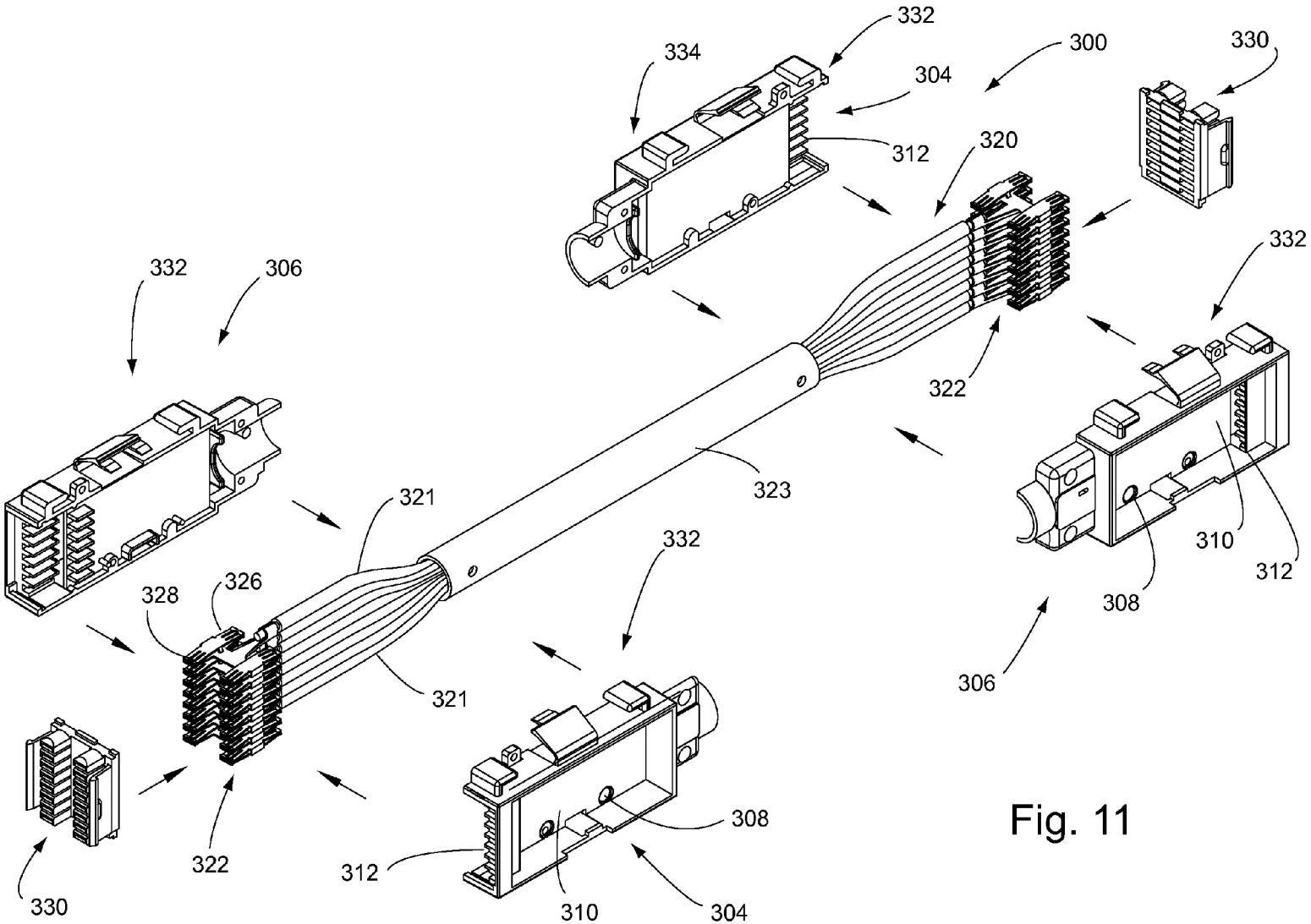
FIG. 11 is a perspective and exploded view of a non-metallic conduit raceway having strain relief properties.
Figure 12:
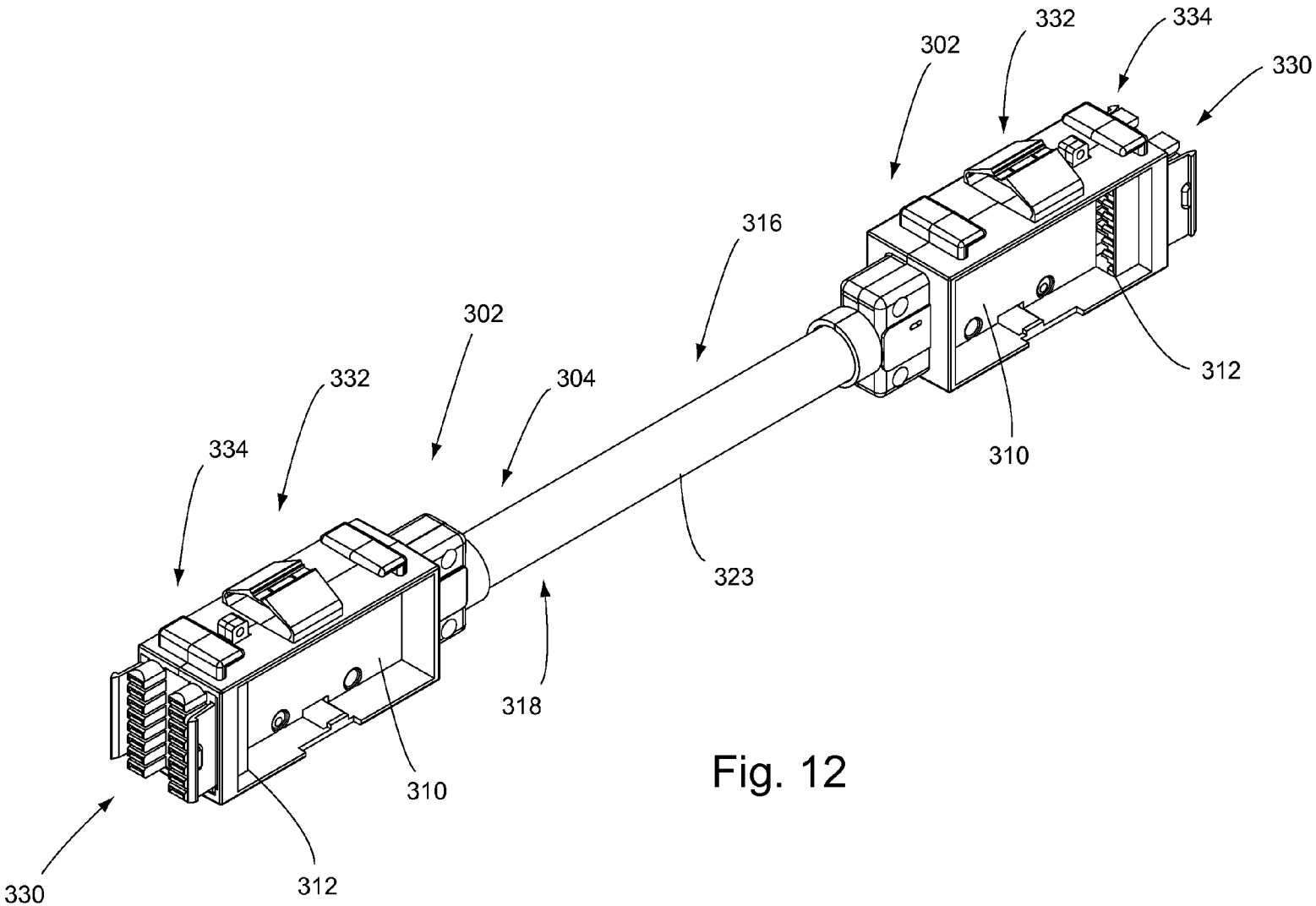
FIG. 12 is a perspective view of the non-metallic conduit raceway illustrated in FIG. 11, but shown in a fully assembled configuration.
Figure 13:
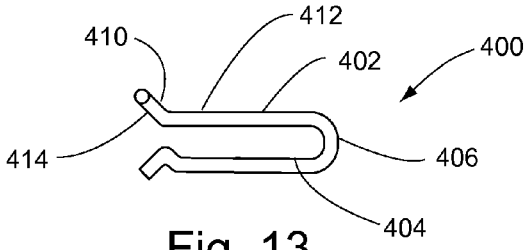
FIG. 13 is a plan view of a grounding clip in accordance with the invention.
Figure 14:
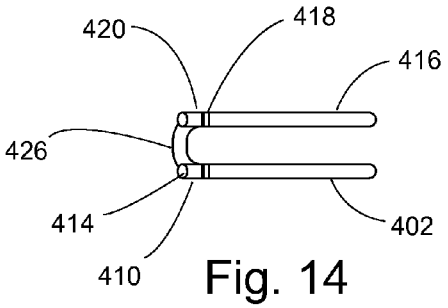
FIG. 14 is a front, elevation view of the clip shown in FIG. 13.
Figure 15:
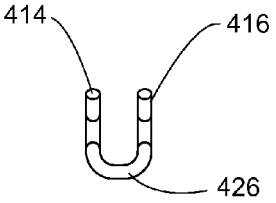
FIG. 15 is a left-side view of the clip shown in FIG. 13.
Figure 16:
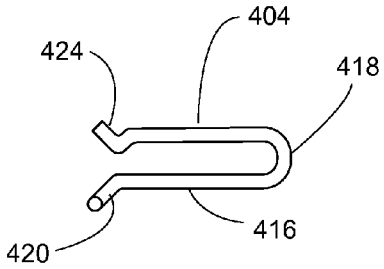
FIG. 16 is an underside view of the clip shown in FIG. 13.
Figure 17:
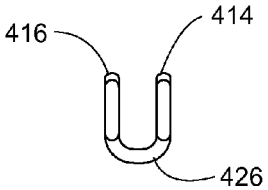
FIG. 17 is a right-side view of the clip shown in FIG. 13.
Figure 18:
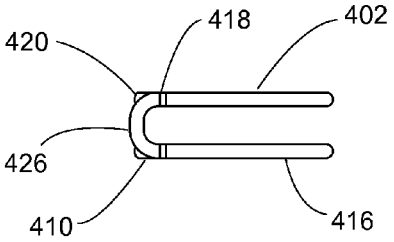
FIG. 18 is an underside view of the clip shown in FIG. 13.
Figure 19:
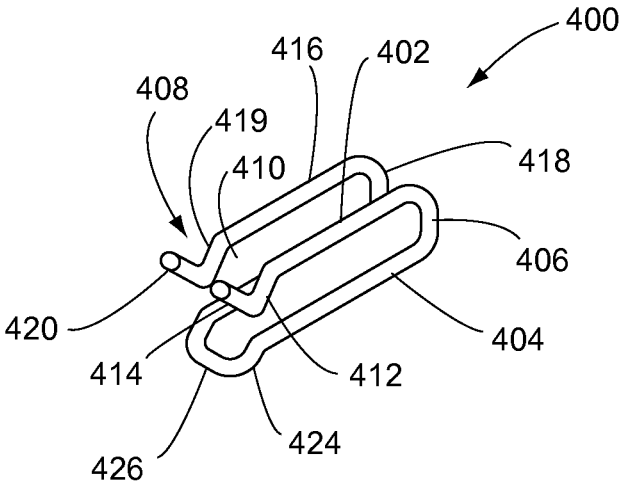
FIG. 19 is a front, perspective view of the clip shown in FIG. 13.

A further embodiment of an adjustable raceway is illustrated in FIGS. 11 and 12, and identified as adjustable raceway 300. With reference thereto, the raceway 300 comprises a pair of junction blocks 302. Each of the junction blocks 302 includes a first half 304 and a second half 306. The junction blocks 302 are adapted to supply power to multiple receptacle blocks which are essentially "plugged in" to the junction blocks 102. For purposes of description of the invention, the multiple receptacle blocks are not shown in the drawings.

To assemble a junction block 302, the first half 304 and the second half 306 are interconnected by means of rivets 308. Each of the junction blocks 302 includes a receptacle space 310. The receptacle space 310 includes a set of receptacle terminals extending outwardly into the corresponding receptacle space 310. The receptacle terminals 312 can comprise a set of male terminals adapted to electrically interconnect to receptacle blocks (not shown) having multiple receptacles. Such receptacle blocks are well known in the electrical industry. Also, the concept of providing the receptacle space 310 and receptacle terminals 312 is well known in the prior art.

Another component of raceway 300 is the bus bar assembly 316 which is essentially located within the conduit 323. The raceway 300 also includes a pair of sets of terminal elements 322. Each of the terminal elements 322 includes a central or connecting beam forming a central bus bar terminal 324. The central bus bar terminal 324 is integral with or otherwise connects electrically to a pair of receptacle terminals 326. The receptacle terminals 326 are, in turn, electrically connected to external terminals 328. The modified terminals 322 are essentially "stacked" in a vertical configuration. The raceway 300 will include a separate modified terminal 322 for each potential entry or exit electrical connection.

The raceway 300 also includes a pair of terminal caps or cable connectors 330. These terminal caps or cable connectors 330 are well known in the art and provide for electrical interconnection between terminals of the terminals 322 and external cables or connectors. Each of these female terminal caps or connectors 330 is provided with a side flange having upper and lower recessed areas. The recessed areas are adapted to assist in providing engagement with flanges of a male connector block associated with a cable assembly (not shown). The side flanges are preferably made of a resilient plastic material and formed integral with the housing of the junction blocks 302. The side flanges can also be provided with an outwardly extending inclined end surface. When the surfaces are engaged by flanges, such as flanges of male cable or connector blocks, the side flanges can be deflected inwardly, allowing the flanges of the male connector block to engage upper and lower recessed areas, so as to provide a releasable locking engagement of the male connector block and the external terminals 328. For purposes of releasing a cable assembly or connector block mechanically and electrically connected to a junction block 302 through the external terminals 328, pressure may be exerted inwardly on the corresponding side flange, and the flanges of the male connector block will then be released from the recesses, and the male connector block can then be retracted from the external terminals 328. In addition, a "keying" arrangement may be utilized for interconnected a cable assembly or connector block to the junction block 302. In this regard, each of the external terminals 328 may be provided with a key lug, and a male connector block may be provided with a key opening for receiving the key lug.

Each of the junction blocks 302 may also be adapted to be secured at its upper structure to a structure for housing electrical components and modular office systems and the like. The means for mounting the junction blocks 302 to such structures can include the use of latch members 332 and raceway connectors 334. Still further the female receptacle terminals 326 will electrically receive the male receptacle terminals 312. Accordingly, an electrical connection is established between the bus bars 321 and the receptacle terminals 312. In this manner, when the receptacle blocks (not shown) are inserted into the junction blocks 302, an electrical connection is established with the bus bars 321.

Further, the cable connectors 330 can then be inserted into the ends of the terminals 322, so that the external female terminals 328 of the terminals 322 are made electrically accessible to cable assemblies or the like (not shown) which may be connected to the cable connectors 330. In this manner, the wireless raceway 300 is provided.

The principles of the invention are disclosed, by way of example, in a series of grounding clips illustrated in FIGS. 13-61. The purpose for the grounding clips is to provide a means for grounding a ground wire to a covering conduit or the like, while possibly still permitting movement of a ground wire so as to provide for adjustability and strain relief.

A grounding clip in accordance with the invention is shown as grounding clip 400, primarily illustrated in a standalone configuration in FIGS. 13-20. Therein, the grounding clip 400 is shown as having a first upper arm 402, and a first lower arm 404. Correspondingly, the clip 400 includes a first V-shaped bight 406 extending between the arms 402, 404. Extending in an opposing direction in the first upper arm 402 is a V-shaped notch 408 formed from a downward projection 412 followed by an upward projection 414 of the first upper arm 402.

The clip 400 also includes a second upper arm 416 and second lower arm 422. A second V-shaped bight 418 is formed between the second upper arm 416 and second lower arm 422. Extending outwardly from an opposing end of second upper arm 416 is a V-shaped notch 408. The notch 408 is formed by a downward projection 419 and an integral upward projection 420.

Figure 21:
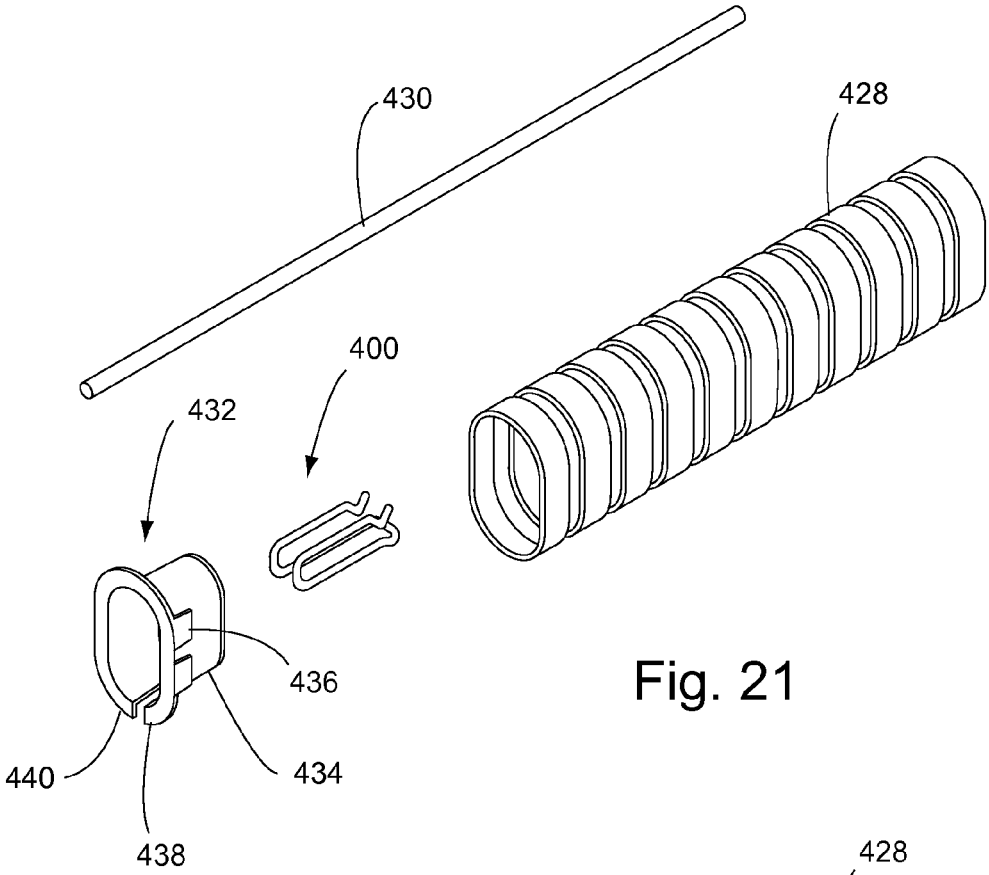
FIG. 21 is an exploded view showing the clip shown in FIG. 13 as applied to a conduit.

Extending outwardly from the first lower arm 404 and second lower arm 422 is a downwardly angled portion 424. The downwardly angled portion 424 forms a U-shaped bight 426 which is integrally connected to the arms 404 and 422. FIGS. 21-24 illustrate the use of the grounding clip 400. Specifically, FIGS. 21-24 illustrate the grounding clip 400 as adapted for use with a conduit 428. The conduit 428 may be conventional in nature, and may carry, on the interior portion thereof, a ground wire 430 which is conductive. The conduit 428 can also carry a number of insulated wires or wires or cables which are protected from conductively connecting to each other. FIG. 21 illustrates conduit 428, ground wire 430 and grounding clip 400 as positioned for purposes of assembly. A protective grommet 432 is also provided. The protective grommet 432 is utilized at the ends of a run of conduit 428 for purposes of shielding or otherwise maintaining an end or edge of the conduit in a protective manner so that the edge or end of the conduit (which may be sharp) does not accidentally cut into any of the wires, cables or other protective insulative materials surrounding the wires.

Figure 20:
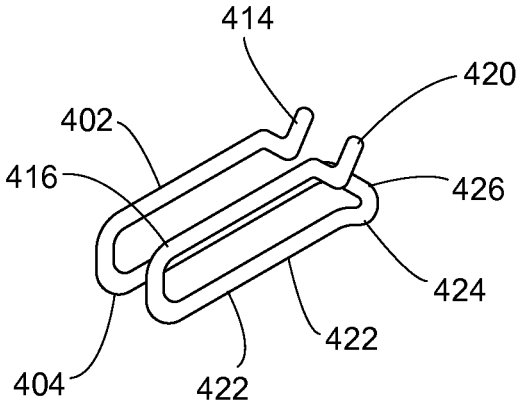
FIG. 20 is a rear, perspective view of the clip shown in FIG. 13.
Figure 22:
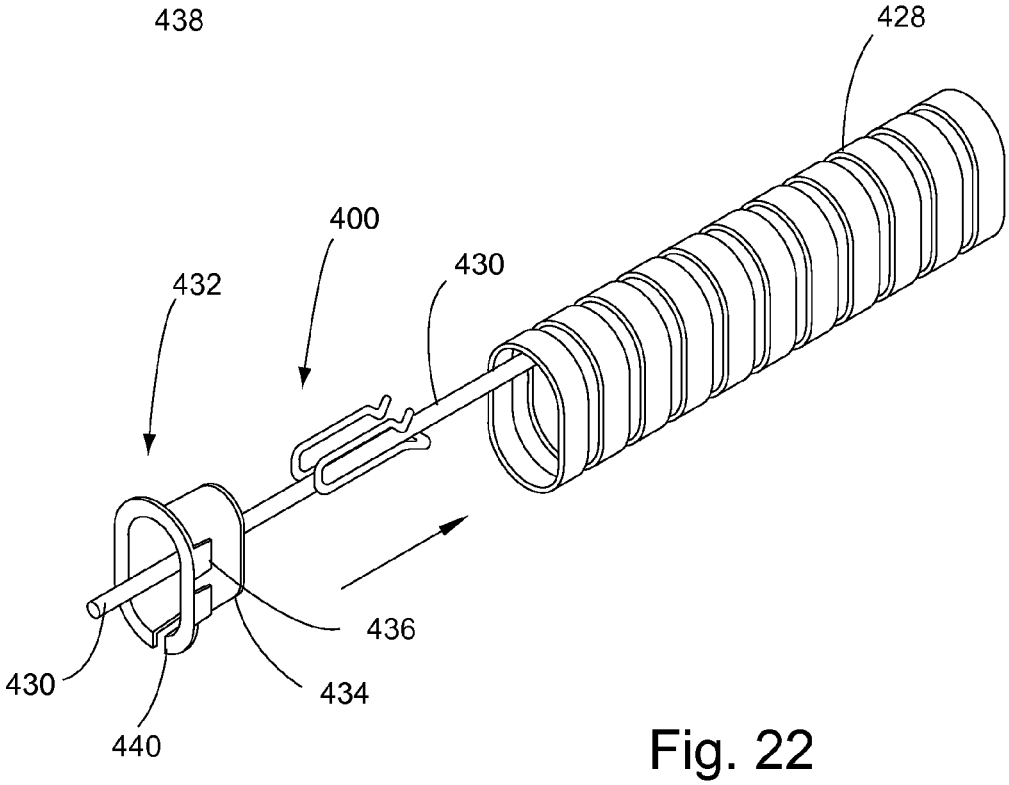
FIG. 22 is a further exploded view showing the components of FIG. 21.
Figure 23:
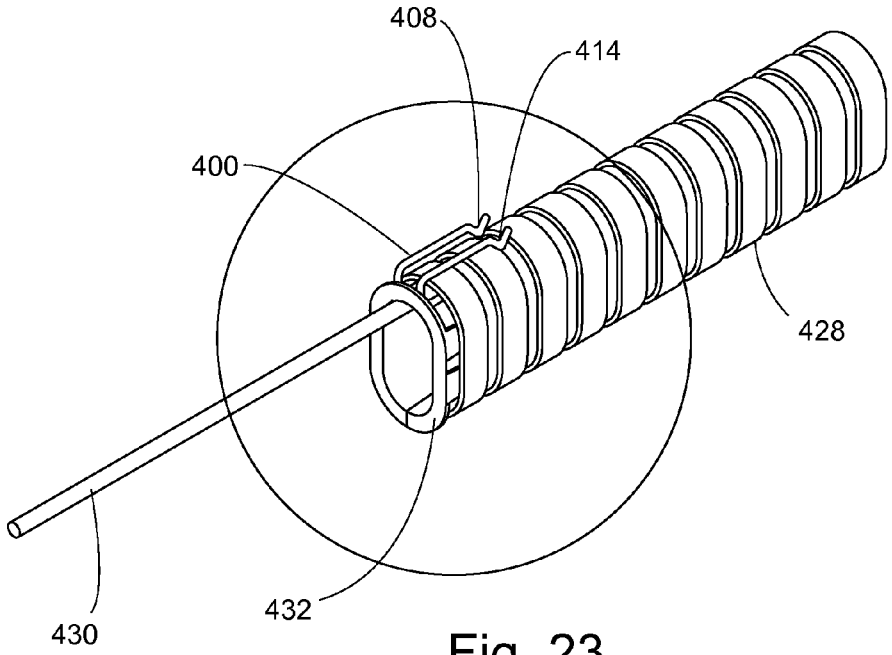
FIG. 23 is a view of the components shown in FIG. 21 in a fully assembled state.
Figure 24:
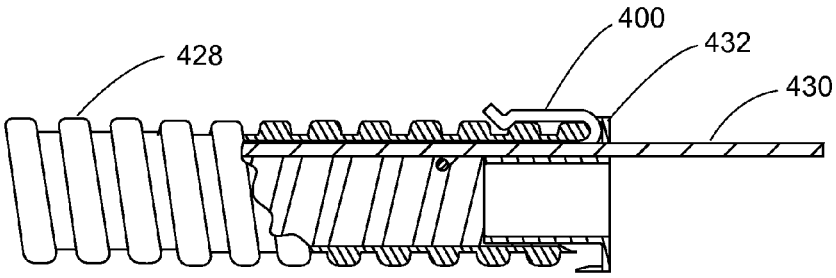
FIG. 24 is a partial, sectional view showing the relative positioning of the grounding clip within the conduit.
Figure 25:
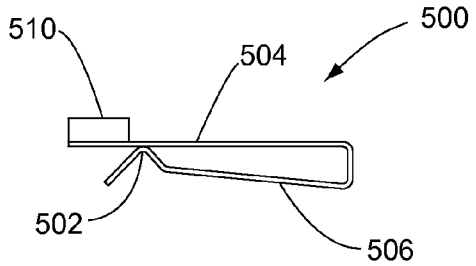
FIG. 25 is a planned view of a second embodiment of a grounding clip in accordance with the invention.
Figure 26:
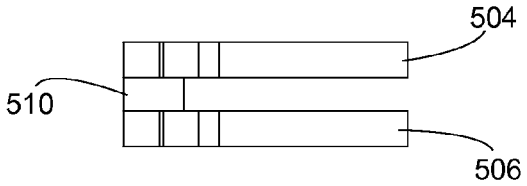
FIG. 26 is a front, elevation view of a clip shown in FIG. 25.
Figure 27:
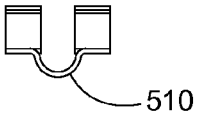
FIG. 27 is a left-side view of the clip shown in FIG. 25.
Figure 28:
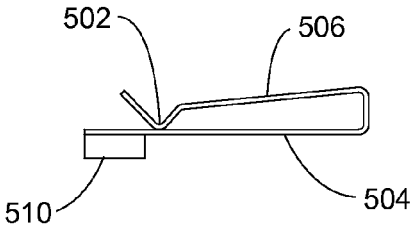
FIG. 28 is an underside view of the clip shown in FIG. 25.
Figure 29:
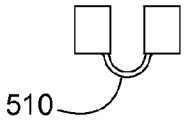
FIG. 29 is a right-side view of the clip shown in FIG. 25.
Figure 30:
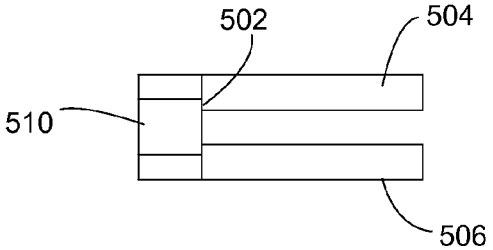
FIG. 30 is a rear view of the clip shown in FIG. 25.
Figure 31:
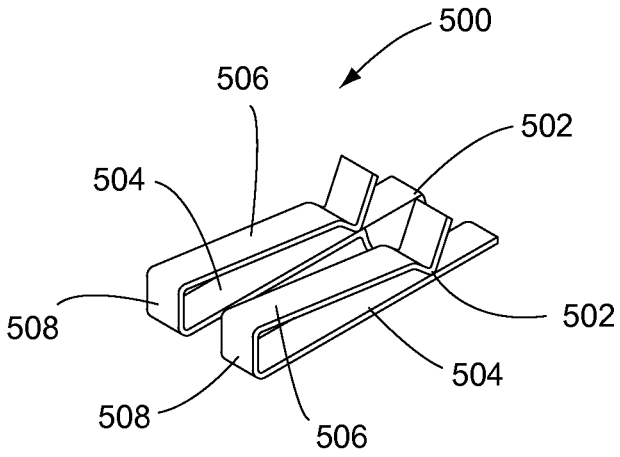
FIG. 31 is a front, perspective view of the clip shown in FIG. 25.
Figure 32:
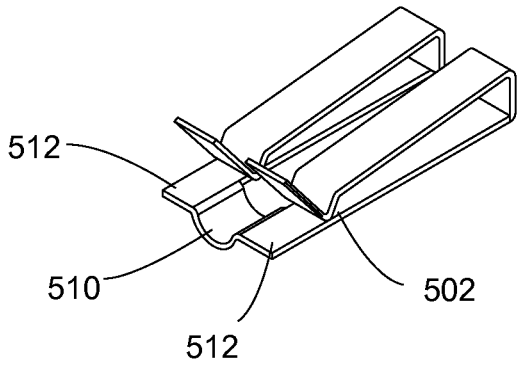
FIG. 32 is a rear, perspective view of the clip shown in FIG. 25.
Figure 33:
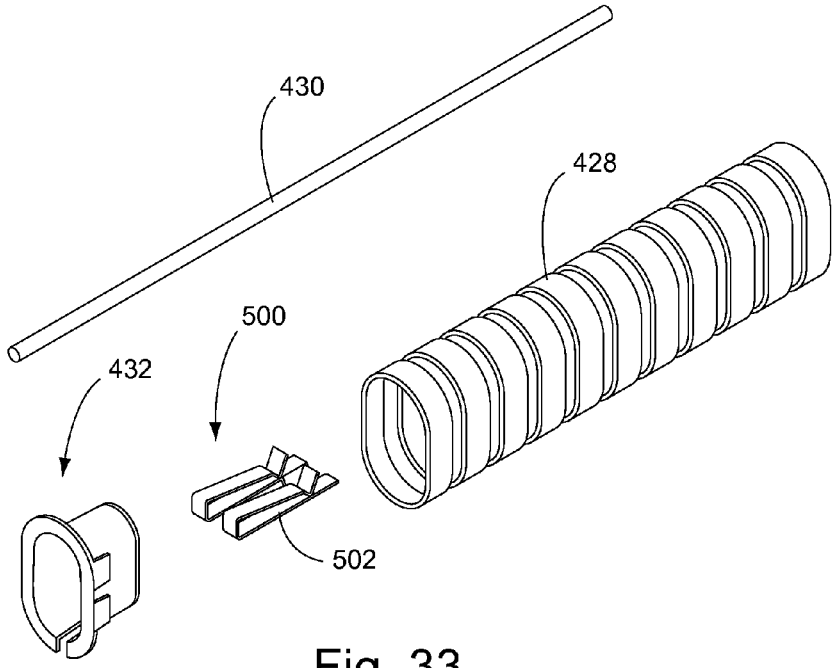
FIG. 33 is a perspective and partially exploded view showing the relative positioning of the clip shown in FIG. 25 as it is inserted into a conduit.
Figure 34:
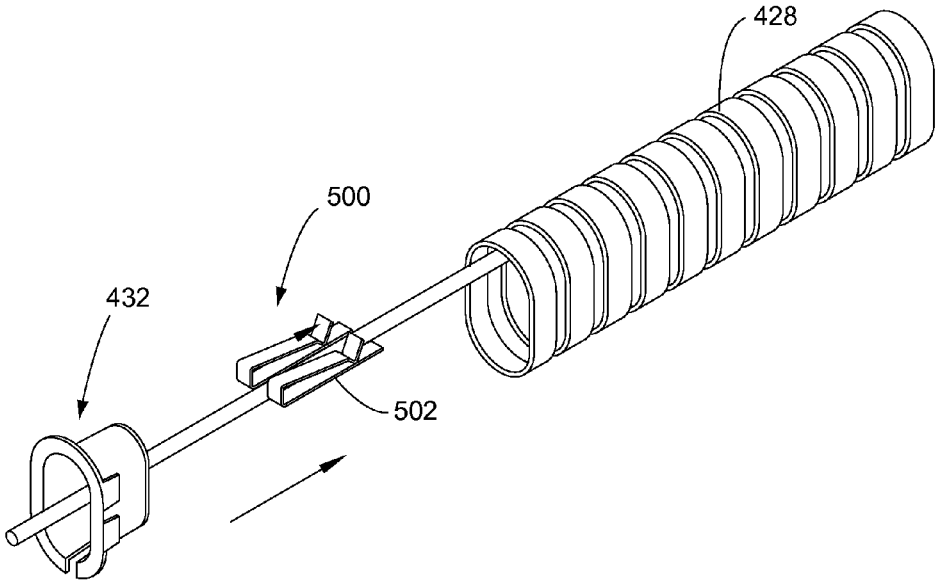
FIG. 34 is a further exploded view similar to FIG. 33.

FIG. 22 illustrates the grounding clip 430 as it is positioned on the ground wire 430, with the ground wire 430 extending into the conduit 428. It should be noted that the particular configuration of the grounding clip 400 as shown in FIG. 22 corresponds to its positional orientation as shown in FIG. 20. FIG. 23 illustrates a final position of assembly of the grounding clip 400, conduit 428, ground wire 430 and protective grommet 432. As shown therein, the arms associated with the V-shaped notches 408 and 410 are positioned on the outside of the conduit and within a slot of the conduit wrapping for purposes of being maintained in a secured position. It should be emphasized that the grounding clips in accordance with the invention are of a resilient nature so as to be capable of proper positioning on the ground wire 430, conduit 428 and protective grommet 432, while also possibly being capable of permitting linear adjustment of the ground wire. Of particular importance, the grounding clip 400 acts so as to provide a grounding connection between the conduit 428 and the ground wire 430. It can be seen that the grounding clip 400 is also positioned on the ground wire 430 so that the ground wire 430 is positioned above the bight 426. It is also noted that the bight 426, being positioned below the ground wire 430, will actually be received within the conduit 428. The protective grommet 432 can then be pressed against and otherwise secured to the conduit 428 through the use of the resilient tabs 436. With this configuration, the housing 434 of the grommet 432 is maintained and received within the conduit 428, and the grommet cover 438 is substantially maintained outside of the conduit 428. This configuration is shown in a partially sectional view in FIG. 24.

A second embodiment of a grounding clip in accordance with the invention is illustrated as grounding clip 500 in FIGS. 25-36. With reference thereto, the grounding clip 500 includes a pair of snap fits 502 formed by angled upper arms 506 which are parallel to each other and oppose each other. Correspondingly, a pair of lower arms 504 extend parallel to each other and form the lower portion of the snap fits 502. The upper arms 506 and lower arms 504 are connected at opposing ends to horizontally disposed ends 508. At the opposing end of the grounding clip 500 is a trough 510 which is formed intermediate opposing ends 512 of the grounding clip 500.

Figure 35:
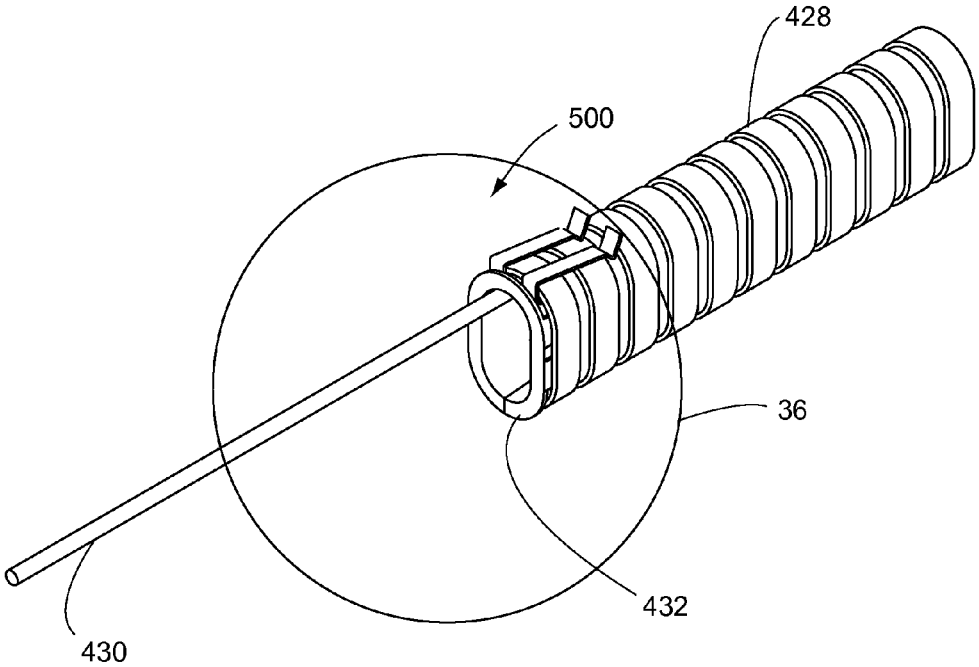
FIG. 35 is a perspective view showing the clip of FIG. 35 in a fully assembled state with the conduit.
Figure 36:
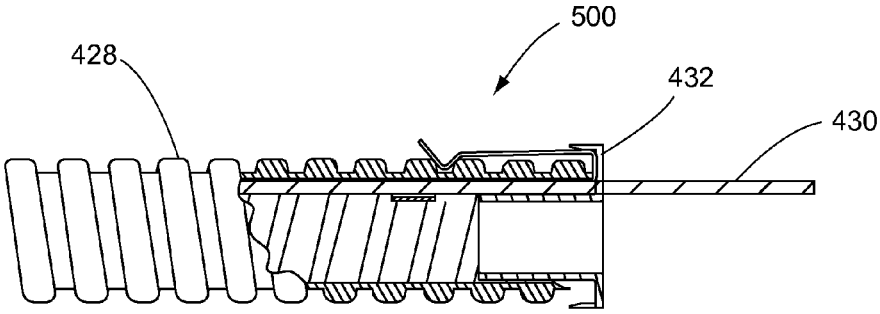
FIG. 36 is a sectional view showing the relative internal position of the clip shown in FIG. 25 within the conduit.
Figure 37:
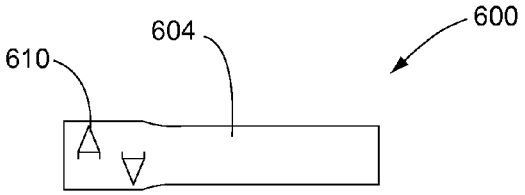
FIG. 37 is a planned view of a third embodiment of a conduit grounding clip in accordance with the invention.
Figure 38:
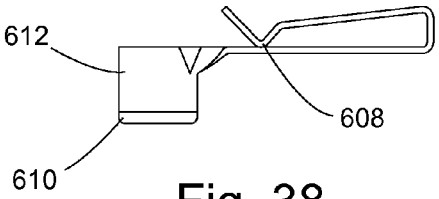
FIG. 38 is a front, elevation view of the clip shown in FIG. 37.
Figure 39:
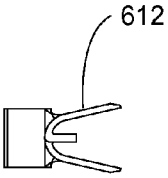
FIG. 39 is a left-side view of the clip shown in FIG. 37.
Figure 40:
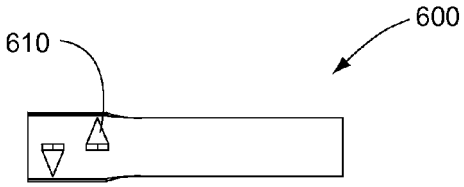
FIG. 40 is an underside view of the clip shown in FIG. 37.
Figure 41:
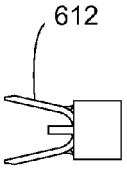
FIG. 41 is a right-side view of the clip shown in FIG. 37.
Figure 42:
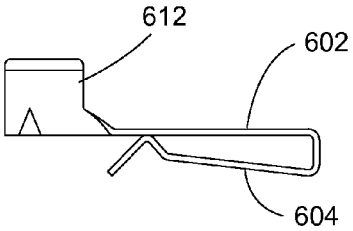
FIG. 42 is a rear view of the clip shown in FIG. 37.
Figure 43:
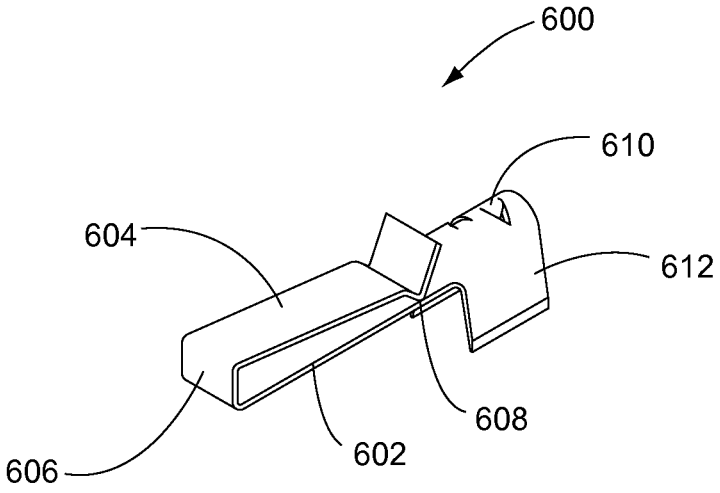
FIG. 43 is a front, perspective view of the clip shown in FIG. 37.
Figure 44:
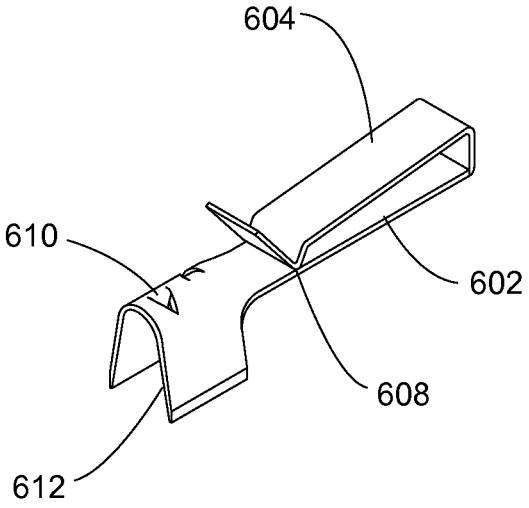
FIG. 44 is a rear, perspective view of the clip shown in FIG. 37.
Figure 45:
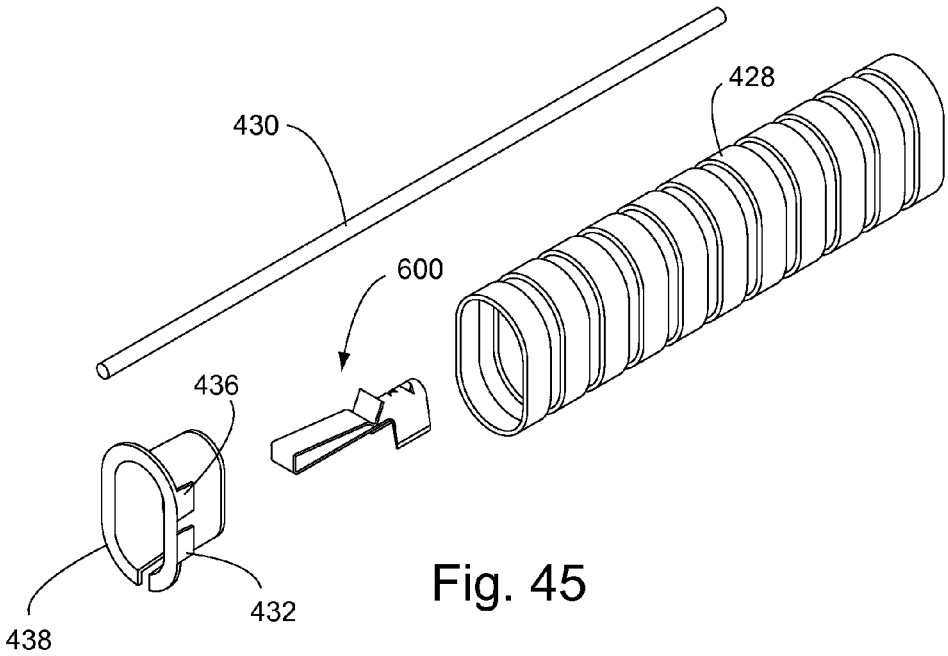
FIG. 45 is a perspective and partially exploded view showing the clip of FIG. 37 as it is to be inserted into a conduit.

FIGS. 33-36 illustrate the assembly of the grounding clip 500. Specifically, and as shown primarily in FIG. 34, the grounding clip 500 is received on the ground wire 430, with the ground wire 430 being received within the trough 510 and extending through the middle of the clip 500 between the lower arms 504. FIGS. 35 and 36 show a final assembly position, with the upper portion of the snap fits 502 being positioned on the outside of the conduit 428, as well as the upper arms 506 being located on the outside thereof. Correspondingly, the lower arms 504 are each received within the conduit 428. As earlier stated, the lower arms 504 are positioned on opposing sides of the ground wire 430, and are received within the conduit 428. With this configuration, the ground wire 430 is held secure against the conduit 428, with the trough 510 facilitating alignment of the ground wire 430.

Figure 46:
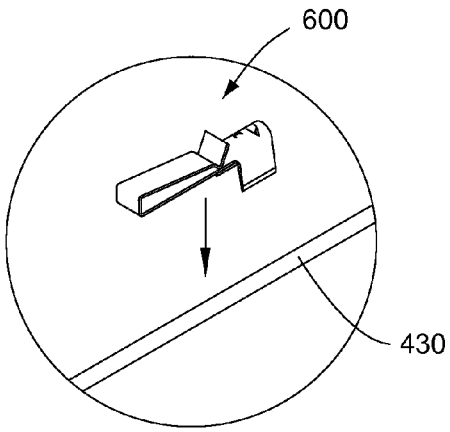
FIG. 46 is an enlarged, perspective view showing the positioning of the clip of FIG. 37 as it is to be positioned on a wire within the conduit.
Figure 47:
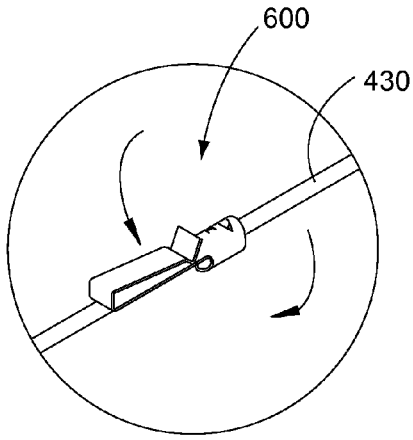
FIG. 47 is an enlarged view showing the clip and wire of FIG. 46 in an assembled state.
Figure 48:
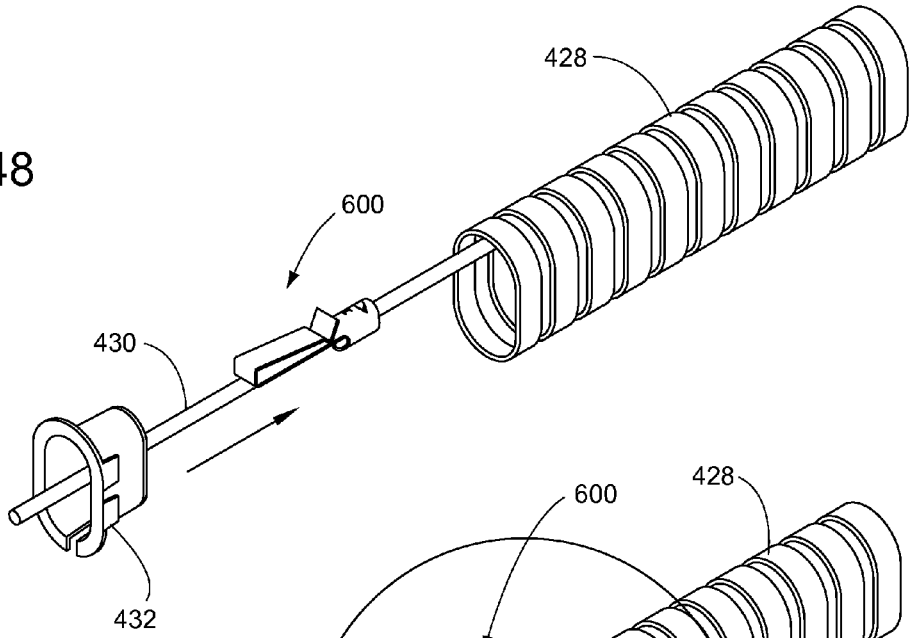
FIG. 48 is a partially exploded view showing the clip and wire of FIG. 47 as they are inserted into a conduit.
Figure 49:
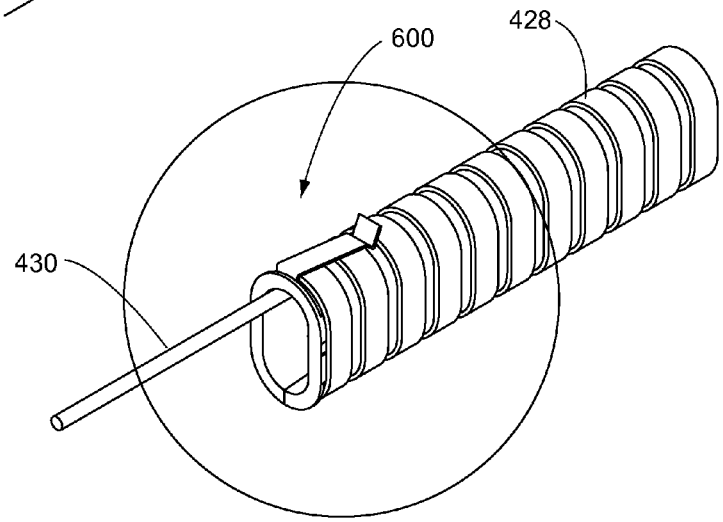
FIG. 49 is a perspective view similar to FIG. 48, but showing the components in a fully assembled state.
Figure 50:
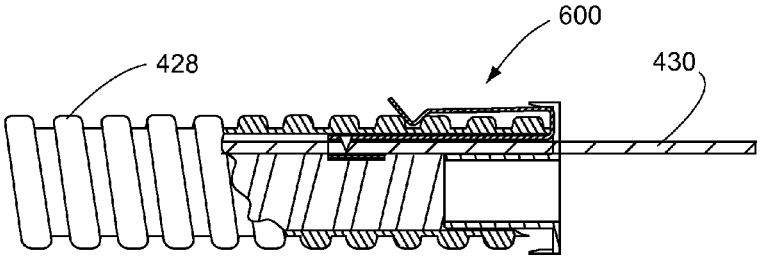
FIG. 50 is a sectional view showing the relative positioning of the clip of FIG. 37 internal to the conduit.
Figure 51:
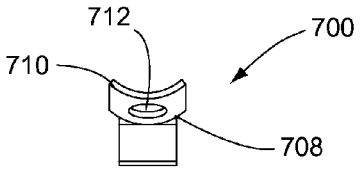
FIG. 51 is a planned view of a fourth embodiment of a grounding clip in accordance with the invention.
Figure 52:
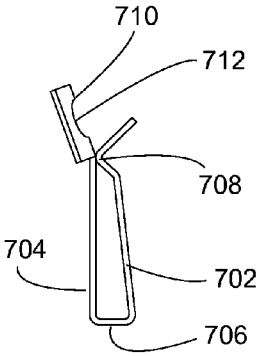
FIG. 52 is a left-side view of the clip shown in FIG. 51.
Figure 53:
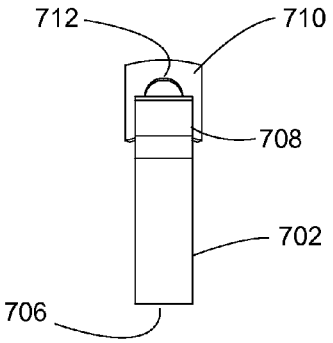
FIG. 53 is a front, elevation view of the clip shown in FIG. 51.
Figure 54:
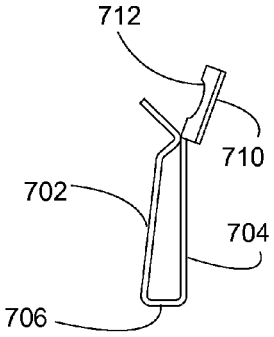
FIG. 54 is a right-side view of the clip shown in FIG. 51.
Figure 55:
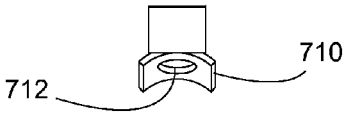
FIG. 55 is an underside view of the clip shown in FIG. 51.
Figure 56:
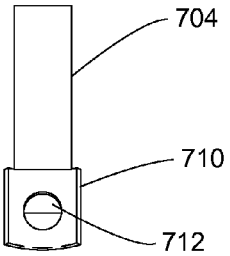
FIG. 56 is a rear view of the clip shown in FIG. 51.
Figure 57:
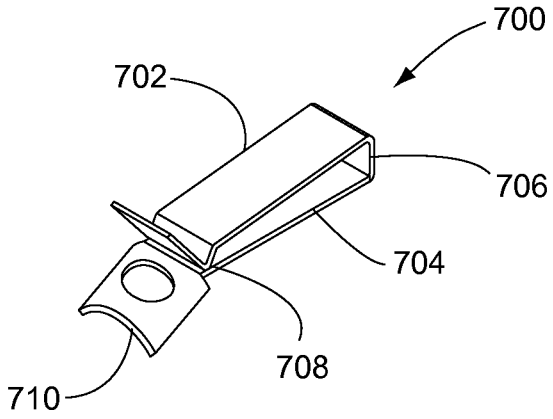
FIG. 57 is a front, perspective view of the clip shown in FIG. 51.
Figure 58:
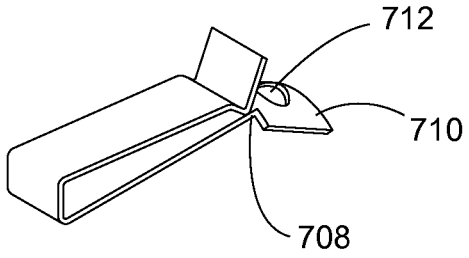
FIG. 58 is a rear, perspective view of the clip shown in FIG. 51.
Figure 59:
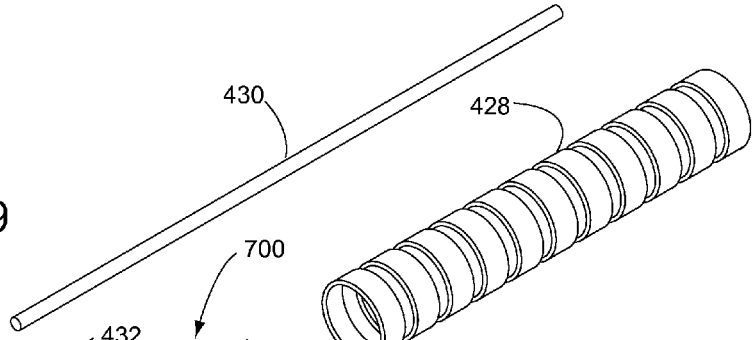
FIG. 59 is an exploded view showing relative positioning of a wire, conduit and the clip shown in FIG. 51.
Figure 60:
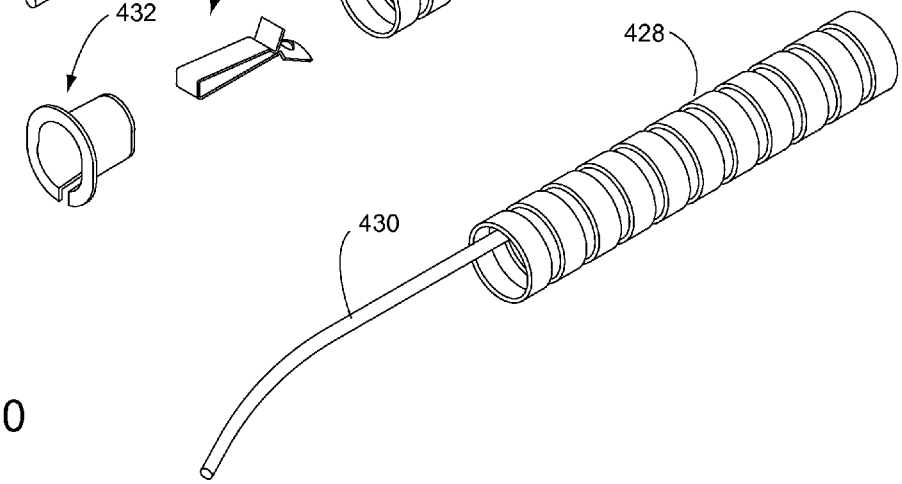
FIG. 60 is an exploded view showing the relative positioning of the grounding clip as it is inserted onto a wire with the conduit.
Figure 61:
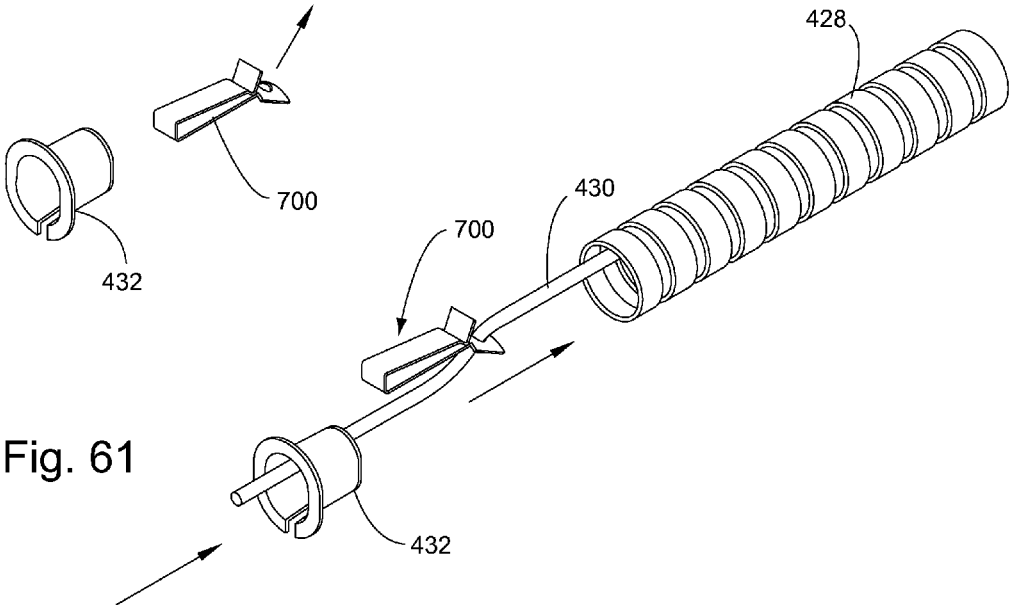
FIG. 61 is a partially exploded and perspective view showing the grounding clip of FIG. 51 assembled onto a wire and ready to be inserted into the conduit.

A still further embodiment of a grounding clip in accordance with the invention is illustrated as grounding clip 600 in FIGS. 37-50. The grounding clip 600, primarily shown in a standalone version in FIGS. 37-44, is an elongated and substantially single piece of metallic material having a lower arm 602 extending outwardly, with an opposing angled upper arm 604. The arms 602 and 604 meet at a horizontally disposed end 606. At an opposing end of the arms 602, 604, a snap fit notch 608 is formed, with the arms 602 and 604 having resiliency for the same. Crimp notches 610 are located on a crimp cover 612 which can be integral with and extending forwardly from the lower arm 602. The crimp cover 612 and crimp notches 610 provide a means for securing the grounding clip 600 in a stationary manner relative to the ground wire 430. This configuration is shown in FIGS. 46, 47 and 50. As shown particularly in the final assembled configuration in FIGS. 49 and 50, the upper angled arm 604 and snap fit 608 are positioned outside the conduit 428. The ground wire 430 extends through the underside of the crimp cover 612 and is secured thereto by actuating the crimp notches 610. A snap fit is provided on the outside of the conduit 428 by the snap fit 608. In this manner, the ground wire 430 can be maintained in a stationary position relative to the conduit 428. Further, the relative position of the ground wire 430 within the conduit 438 can be manipulated by turning the grounding clip 600 in any direction desired for connection to the conduit 428 (see FIG. 47).

An additional embodiment of a grounding clip in accordance with the invention is illustrated as grounding clips 700 in FIGS. 51-61. As shown primarily in FIGS. 51-58, the grounding clip 700 is a "single unit" clip made of substantially a single metallic element. The grounding clip 700 includes an angled upper arm 702 and a relatively horizontal lower arm 704. The upper arm 702 and lower arm 704 are connected together at one end 706. At an opposing end, a snap fit configuration 708 is formed between the arms 702, 704. Extending outwardly from the lower arm 704 is what can be characterized as an aperture arm 710. The aperture arm 710 primarily provides for positioning of an aperture 712. When assembled, ground wire 430 will be received through the aperture 712. Assembly of the grounding clip 700 with the conduit 428 and ground wire 430 is primarily shown in FIGS. 59, 60 and 61. As shown therein, the ground wire 430 is received within the aperture 712 of the aperture arm 710. This aperture arm 712 is then received within the conduit 428. The snap fit section 708 is then received on the outside of the conduit 428, along with the upper arm 702. Along with the aperture arm 710, the lower arm 704 is also received within the conduit 428. With this configuration, the ground wire 430 is substantially maintained in a relatively stationary position within the conduit 428, but is allowed to move longitudinally for purposes of providing for excess wire and the like.

It will be apparent to those skilled in the pertinent arts that other embodiments of grounding assemblies in accordance with the invention can be designed. That is, the principles of the invention are not limited to the specific embodiments described herein. Accordingly, it will be apparent to those skilled in the art that modifications and other variations of the above-described illustrative embodiments of the invention may be effected without departing from the spirit and scope of the novel concepts of the invention.

The invention claimed is:

1. A grounding configuration is adapted for use to supply and transfer electrical power, said grounding configuration comprising:

at least one cover conduit having an elongated configuration;

a plurality of electrical wires extending through said covering conduit;

at least one of said electrical wires comprising a ground wire;

at least one grounding clip having at least a partial resilient configuration;

said grounding clip being releasably secured to said ground wire and said conduit; and said grounding clip being releasably secured to said ground wire and said conduit, so that said grounding clip acts so as to provide a grounding connection between said conduit and said ground wire.

2. A grounding configuration in accordance with claim 1, characterized in that said grounding clip is secured to said ground wire and said covering conduit in a manner so that said ground wire is linearally adjustable within said covering conduit, and relative to said covering conduit.

3. A grounding configuration in accordance with claim 1, characterized in that said grounding clip is positioned on said ground wire so that said ground wire is positioned above a bight of said grounding clip, with said bight being received within said conduit.

4. A grounding configuration in accordance with claim 3, characterized in that:

said grounding configuration further comprises a protective grommet utilized at the ends of a run of said covering conduit for purposes of shielding or otherwise maintaining an end or edge of said conduit in a protective manner;

with said bight being positioned below said ground wire, and received within said conduit, said protective grommet can be pressed against and otherwise secured to said conduit through the use of resilient tabs;

a housing of said grommet is maintained and received within said conduit; and a grommet cover of said grommet is substantially maintained outside of said conduit.

5. A grounding configuration in accordance with claim 1, characterized in that said grounding clip comprises:

a first upper arm;

a first lower arm;

a first V-shaped bight extending between said arms;

a V-shaped notch extending in an opposing direction in said first upper arm, and formed from a downward projection followed by an upper projection of said first upper arm;

a second upper arm;

a second lower arm;

a second V-shaped bight formed between said second upper arm and said second lower arm;

a second V-shaped notch extending outwardly from an opposing end of said second upper arm;

said second notch is formed by a downward projection and an integral upper projection of said second upper arm;

a downwardly angled portion extending outwardly from said first lower arm and said second lower arm; and said downwardly angled portion forms a U-shaped bight integrally connected to said first lower arm and said second lower arm.

6. A grounding configuration in accordance with claim 1, characterized in that said grounding clip comprises:

a pair of snap fits formed by angled upper arms which are parallel to each other and oppose each other;

a pair of lower arms extending parallel to each other and forming a lower portion of said snap fits;

said upper arms and said lower arms are connected at opposing ends to horizontally disposed ends;

at an opposing end of said grounding clip is a trough which is formed intermediate opposing ends of said grounding clip.

7. A grounding configuration in accordance with claim 6, characterized in that:

said grounding clip is received on said ground wire, with said ground wire being received within said trough and extending through a middle of said clip between said lower arms;

in a final assembly position, said upper portion of said snap fits is positioned on an outside of said conduit, as well as said upper arms being located on said outside thereof each of said lower arms are received within said conduit said lower arms are positioned on opposing sides of said ground wire; and with the configuration, said ground wire is held secured against said conduit, with said trough facilitating alignment of said ground wire.

8. A grounding configuration in accordance with claim 1, characterized in that said grounding clip comprises:

an elongated and substantially single piece of metallic material having a lower arm extending outwardly therefrom;

an opposing angled upper arm;

said lower arm and said upper arm meet at a horizontally disposed end;

at an opposing end of said arms, a snap fit notch is formed, with said arms having resiliency for the same;

crimp notches located on a crimp cover and integral with and extending forwardly from said lower arm;

said crimp cover and said crimp notches provide a means for securing said grounding clip in a stationary manner relative to said ground wire;

said upper angled arm and said snap fit are positioned outside of said conduit;

said ground wire extends through an underside of said crimp cover and is secured by actuating said crimp notches;

a snap fit is provided on the outside of said conduit said ground wire is maintained in a stationary position relative to said conduit if desired, and said relative position of said ground wire within said conduit can be manipulated by turning said grounding clip in any direction desired for connection to said conduit.

9. A grounding configuration in accordance with claim 1, characterized in that said grounding clip comprises:

a single unit clip made of a substantially single metallic element;

an angled upper arm and a relatively horizontal lower arm, each of said arms being connected together at one end;

a snap fit configuration formed between said arms at an opposing end of said arms;

an aperture arm extending outwardly from said lower arm, said aperture arm primarily providing for positioning of an aperture;

said ground wire is received through said aperture when assembled;

said aperture is received within said conduit, and said snap fit section is received on an outside of said conduit, along with said upper arm;

said lower arm is received within said conduit, along with said aperture arm; and said ground wire is substantially maintained in a relatively stationary position within the conduit, but is movable longitudinally for purposes of providing for excess wire and the like.

* * * * *